US012543852B2

(12) United States Patent
Rahilly et al.

(10) Patent No.: US 12,543,852 B2
(45) Date of Patent: Feb. 10, 2026

(54) SECURE RECEPTACLE WITH CONTAINER CAROUSEL

(71) Applicant: CareFusion 303, Inc., San Diego, CA (US)

(72) Inventors: Michael K. Rahilly, Encinitas, CA (US); Edward Stephen Ferner, Escondido, CA (US)

(73) Assignee: CAREFUSION 303, INC., San Diego, CA (US)

( * ) Notice: Subject to any disclaimer, the term of this patent is extended or adjusted under 35 U.S.C. 154(b) by 879 days.

(21) Appl. No.: 17/713,190

(22) Filed: Apr. 4, 2022

(65) Prior Publication Data

US 2022/0312961 A1 Oct. 6, 2022

Related U.S. Application Data

(60) Provisional application No. 63/171,059, filed on Apr. 5, 2021.

(51) Int. Cl.
*A47B 49/00* (2006.01)

(52) U.S. Cl.
CPC ..... *A47B 49/002* (2013.01); *A47B 49/008* (2013.01)

(58) Field of Classification Search
CPC .... A47B 49/002; A47B 49/008; A61J 7/0084; A61J 2205/60; G16H 20/13; G16H 40/20; G16H 40/63; G07F 11/52; G07F 17/0092; B65D 25/02; B65D 43/26; B65G 1/02; B65G 1/04; B65G 1/133; B65G 1/1371
See application file for complete search history.

(56) References Cited

U.S. PATENT DOCUMENTS 4,573,606 A 3/1986 Lewis et al.
5,176,285 A * 1/1993 Shaw ..... A61J 7/0084 221/113
5,722,332 A * 3/1998 Fumanelli ..... G07D 11/12 109/66
5,745,366 A 4/1998 Higham et al.
(Continued)

FOREIGN PATENT DOCUMENTS

CN 104334052 A 2/2015
EP 2239714 A1 10/2010

OTHER PUBLICATIONS

Canadian Office Action for Application No. 3,154,146, dated Feb. 20, 2024, 6 pages.
(Continued)

*Primary Examiner* — Michael Collins
(74) *Attorney, Agent, or Firm* — MASCHOFF BRENNAN

(57) ABSTRACT

A secure receptacle includes within it a vertically-aligned carousel having a plurality of securable containers horizontally disposed around the carousel. Each container includes a securable lid preventing access to the contents of the container, and the vertically-aligned carousel is configured to lock in a secured position. A sensor within the secure receptacle determines a position of the carousel, and a motorized controller rotates the carousel to a requested position. On determining a requested container, the carousel is rotated so that the requested container is moved from a current position to the opening of the secure receptacle, and the securable lid of the requested container is actuated to provide access to its contents.

20 Claims, 22 Drawing Sheets

(56) References Cited

U.S. PATENT DOCUMENTS

| | | | | |
|---|---|---|---|---|
| 5,905,653 | A | 5/1999 | Higham et al. | |
| 6,170,929 | B1 * | 1/2001 | Wilson | A61B 50/13 221/21 |
| 8,068,934 | B2 * | 11/2011 | Saltsov | A61J 7/0481 221/121 |
| 9,268,978 | B2 * | 2/2016 | Hussain | G16H 20/13 |
| 11,207,243 | B2 * | 12/2021 | Lam | A61J 7/0445 |
| 2005/0061825 | A1 * | 3/2005 | Willoughby | G07F 11/68 221/2 |
| 2009/0055018 | A1 * | 2/2009 | Meek, Jr. | E05B 47/026 700/237 |
| 2014/0277702 | A1 * | 9/2014 | Shaw | G07F 17/0092 700/232 |
| 2021/0401673 | A1 * | 12/2021 | Feng | G16H 40/63 |

OTHER PUBLICATIONS

European Search Report of Application No. EP 22166712.4 dated Aug. 31, 2022, 9 pages.
Australian Office Action for Application No. 2022202245, dated Jul. 4, 2025, 3 pages.
Extended European Search Report for Application No. 25158456.1, dated Jun. 12, 2025, 12 pages.
Chinese Office Action for Application No. 202210360025.7, dated Sep. 27, 2025, 44 pages including translation.

* cited by examiner

SECURE RECEPTACLE WITH CONTAINER CAROUSEL

CROSS-REFERENCE TO RELATED APPLICATION

This application claims the benefit of U.S. Provisional Application No. 63/171,059, filed on Apr. 5, 2021, the entirety of each of which is incorporated herein by reference for all purposes.

TECHNICAL FIELD

The present disclosure generally relates to the transport of medications and, in particular, transfer of medications between a pharmacy and a dispensing system.

BACKGROUND

Patients are routinely prescribed a number of medications while in a hospital. Many hospitals utilize automated dispensing machines (ADMs) to securely store and dispense medications at sites, for example a nursing station, that are remote from the pharmacy. While certain medications are stocked in the ADMs, it is necessary to replenish the stock of medications on a regular basis. In addition, as most ADMs do not have the capacity to store all possible medications, a doctor may prescribe a medication that is not currently stocked in the local ADM and the pharmacy must send this medication to the ADM. Thus, there is a regular transfer of medications from the pharmacy to multiple ADMs within the hospital or, in certain circumstances, to ADMs located in other hospitals. Additionally, injectable medication syringes must be disposed of safely and securely from potential diverters.

SUMMARY

It is advantageous to provide a mobile carrier that provides power and a communication link to secure receptacles such that the secure receptacles may be filled, checked, and operated at locations other than fixed filling and dispensing systems. The subject technology described herein addresses the problems with existing methods of transporting and disposing of medications.

In this regard, a secure receptacle, comprises a body forming a compartment therein and comprising an opening to the compartment; a docking interface comprising one or more electrical connectors disposed on an outer portion of the body for docking the secure receptacle with a docking station and communicating with a processor of the docking station; a vertically-aligned carousel disposed within the compartment and comprising a plurality of securable containers horizontally disposed around a rotational axis of the vertically-aligned carousel, each securable container comprising a securable lid preventing access to the secure container when the securable lid is in a closed position, wherein the vertically-aligned carousel is configured to lock in a secured position in which each securable lid of each of the plurality of secure containers in the closed position; a sensor for determining a position of the vertically-aligned carousel and identifying which of the plurality of securable containers is positioned at the opening of the compartment; a motorized controller configured to rotate the vertically-aligned carousel based on one or more commands received via the docking interface from the processor of the docking station, wherein the secure receptacle is configured to receive the one or more commands from the docking interface and, in response to the one or more commands, determine from the one or more commands a requested container of the plurality of securable containers, obtain a current position of the requested container using the sensor, and rotate the vertically-aligned carousel so that the requested container is moved from the current position to the opening of the compartment, and actuate the securable lid of the requested container to provide access to an interior of the requested container through the opening of the compartment.

According to various implementations, the secure receptacle further comprises a receptacle processor communicatively connected to the docking interface, the sensor, and the motorized controller, and the receptacle processor receives the one or more commands from the processor of the docking station, receives the current position from the sensor, and instructs the motorized controller to rotate the vertically-aligned carousel without further action by the processor of the docking station. In some implementations, the secure receptacle comprise a non-transitory machine-readable memory accessible by the processor; and a lid sensor, and the processor of the secure receptacle is configured to: receive the one or more commands via the docking interface, the one or more commands comprising a request to deposit an item in the secure receptacle and an identify of a user; determine, based on information stored in the memory, an empty container of the plurality of securable containers as the requested container; rotate the vertically-aligned carousel so that the requested container is moved from the current position to the opening of the compartment; actuate the securable lid of the requested container to open the securable lid and provide access to an interior of the requested container through the opening of the compartment; receive a signal from the lid sensor indicating that the securable lid of the requested container has been closed; secure the securable lid of the requested container; and record, in the memory, an association between the identity of the user and the requested container in the vertically-aligned carousel. Other aspects include corresponding systems, apparatuses, methods, and computer program products for implementation of the foregoing features.

BRIEF DESCRIPTION OF THE FIGURES

The accompanying drawings, which are included to provide further understanding and are incorporated in and constitute a part of this specification, illustrate disclosed embodiments and together with the description serve to explain the principles of the disclosed embodiments. In the drawings.

DESCRIPTION

In the following detailed description, numerous specific details are set forth to provide a full understanding of the present disclosure. It will be apparent, however, to one ordinarily skilled in the art that embodiments of the present disclosure may be practiced without some of the specific details. In other instances, well-known structures and techniques have not been shown in detail so as not to obscure the disclosure.

Figure 1:
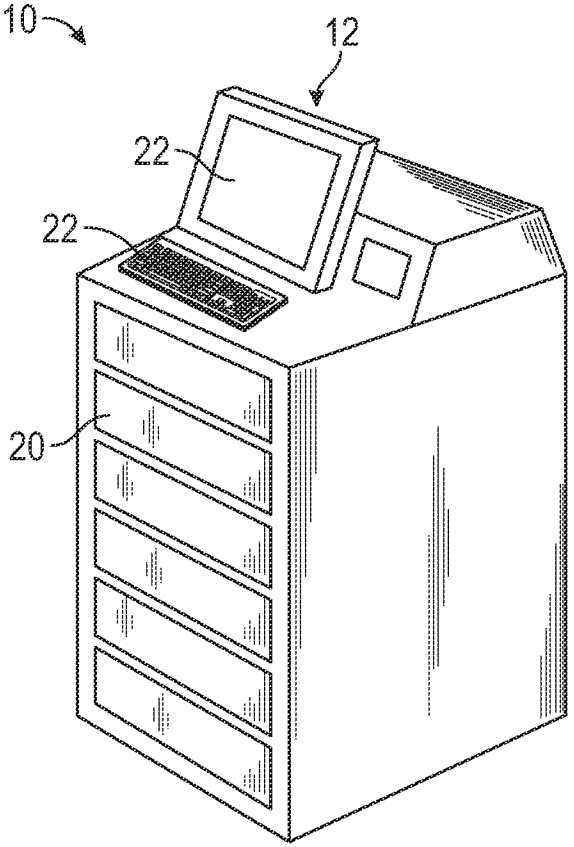
FIG. 1. depicts an example dispensing system, according to various aspects of the subject technology.

FIG. 1. depicts an example dispensing system 10, according to various aspects of the subject technology. This system 10 includes an automated dispensing machine (ADM) 12 with a plurality of drawers 20. In some embodiments, the drawers 20 are secured such that the contents are not available for removal. The ADM 12 includes a user interface 22 and a processor (not visible in FIG. 1) that accepts input from the user through the user interface 22. An example dispensing process would begin with a user providing the credentials to the ADM 12, for example by providing a login name and password through the user interface 22, or by scanning a radio frequency identification (RFID) device such as a badge with an RFID chip embedded therein, with a radio frequency identification (RFID) sensor 24 located on the ADM 12. The ADM processor verifies that the identified user is authorized to remove at least one item from the ADM 12, and activates an item-selection display. The user selects an item to be dispensed. The ADM processor verifies that the user is authorized to remove the selected item and unlocks the drawer 20 that contains the selected item. The user removes the item, closes the drawer 20, and logs out, whereupon the ADM 12 locks the opened drawer 20.

Figure 2:
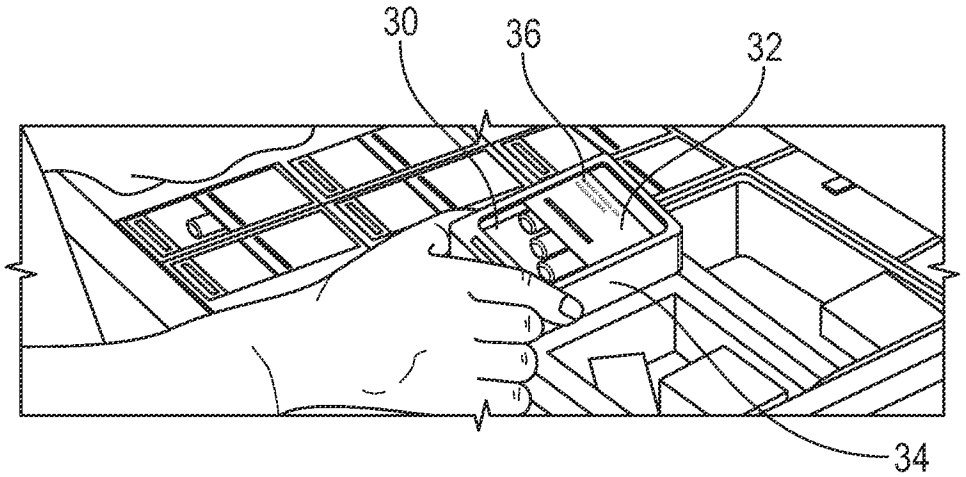
FIG. 2 depicts an open drawer of the dispensing system of FIG. 1 with receptacles contained therein, according to various aspects of the subject technology.

FIG. 2 depicts an open drawer 20 of the ADM 12 of FIG. 1 with receptacles 30 contained therein, according to various aspects of the subject technology. Receptacles 30 may be marked with a label 32, including text 34 that provides information regarding the medication contained in the receptacle 30, for example the medication name, dose, and expiration date. Label 32 may also includes a barcode 36 that may contain a portion of the same information or additional information, such as a tracking number associated with the latest filling of this particular receptacle 30. In some embodiments, receptacle 30 may include an RFID tag that stores and transmits the same information when scanned by an RFID scanner. When the receptacle 30 is plugged into the drawer 20, the ADM processor of the ADM 12 can communicate with the memory of the receptacle 30 and retrieve the identification number associated with this receptacle 30. In some systems, a central database (not shown in FIG. 2) contains a list of identification numbers and information regarding the contents of the respective receptacles 30 and the ADM 12 can communicate with this database to retrieve this information, or provide communications between the database and receptacle 30 when receptacle 30 is docked with a docking interface of drawer 20. Thus, plugging a receptacle 30 into the drawer 20 informs the processor of the ADM 12 of the contents of that receptacle 30.

Figure 3:
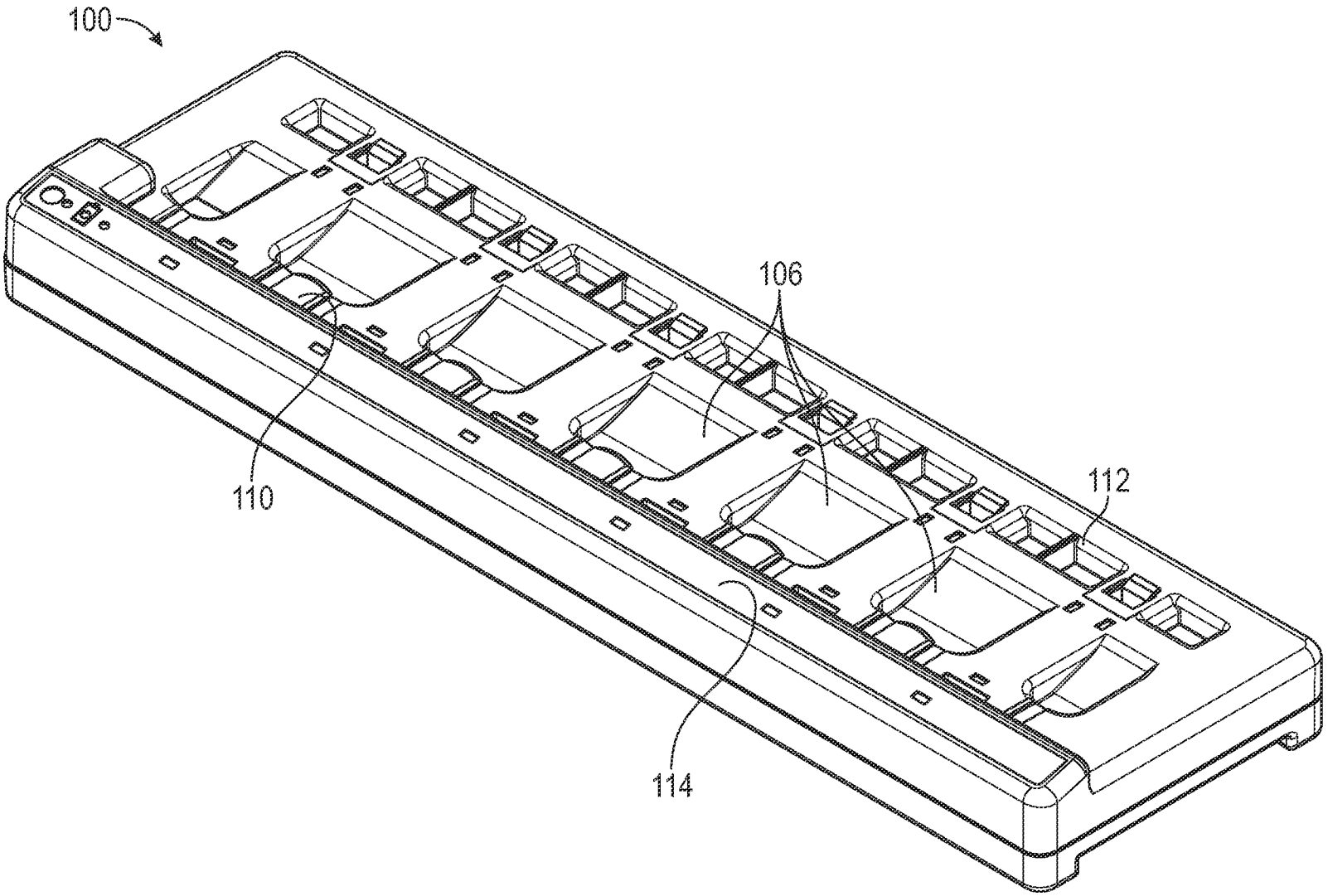
FIG. 3 depicts an exemplary portable smart carrier, according to various aspects of the present disclosure.

FIG. 3 depicts an exemplary portable smart carrier 100, according to various aspects of the present disclosure. This embodiment of the smart carrier 100 comprises a body 102 with a handle 104, a plurality of docking locations 106, a processor 120 (not visible in FIG. 3, shown in FIG. 5), and an external connector 108. In general, the smart carrier 100 is sized to be portable and easily carried, for example by the handle 104, and transported, for example on a cart. Each of the docking locations 106 comprises a connector 110, a retention feature 112, and an indicator 114. In certain embodiments, the connector 110 includes electrical contacts (not visible in FIG. 3) that may provide one or more of power, ground, and communication lines. In certain embodiments, the retention feature 112 comprises a detent element (not visible in FIG. 3) that retains a latching feature of a secure receptacle (not shown in FIG. 3) until the applied removal force exceeds a predetermined value. In certain embodiments, the retention feature 112 comprises a locking element (not visible in FIG. 3) that retains a latching feature of a secure receptacle (not shown in FIG. 3) until the locking element is unlocked by a command from the processor 120. In certain embodiments, the indicator 114 comprises a visual indicator, for example a light-emitting diode (LED).

Figure 4:
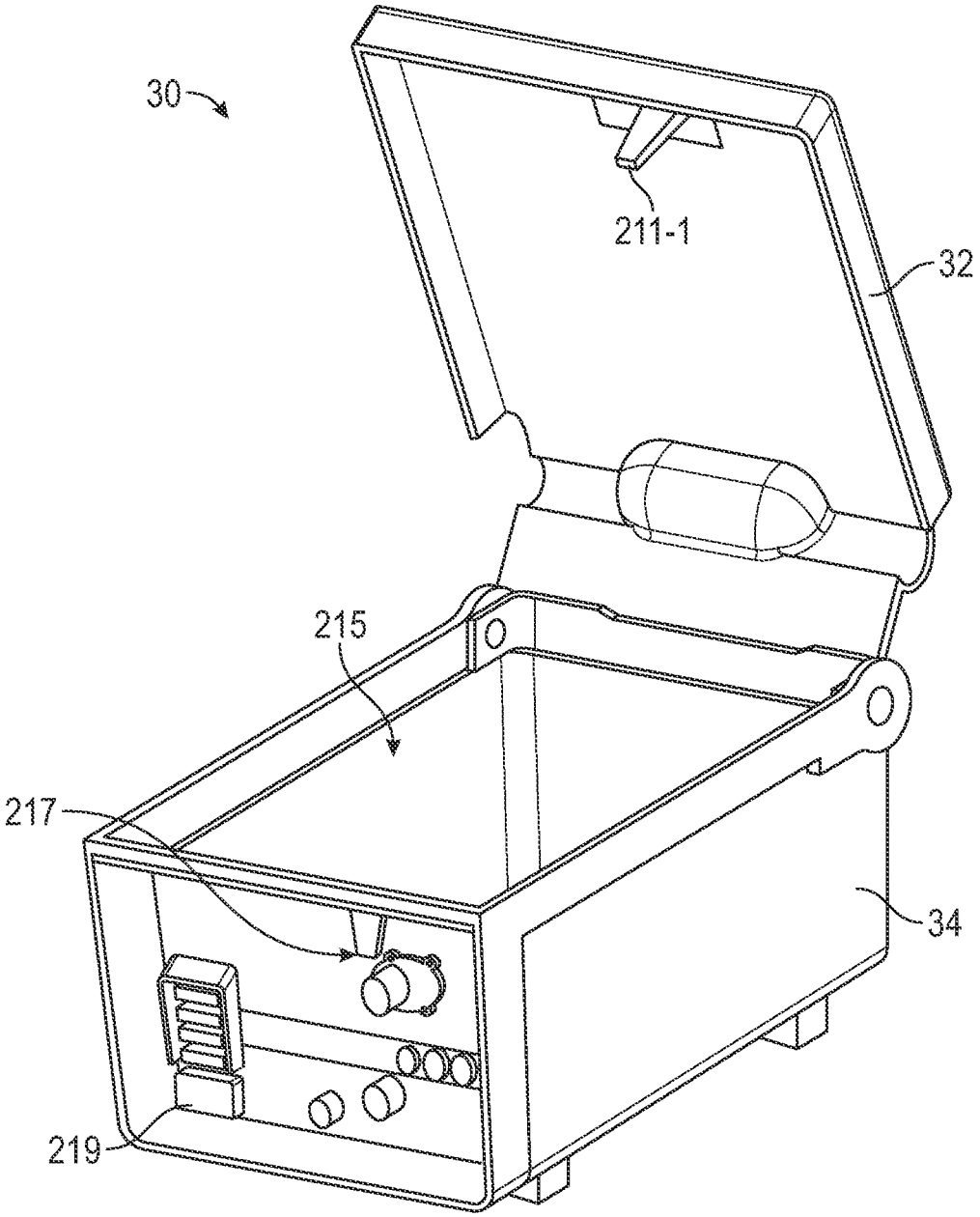
FIG. 4 is an example illustration of a secure receptacle, according to various aspects of the subject disclosure.

FIG. 4 is an example illustration of a secure receptacle 30, according to various aspects of the subject disclosure. Secure receptacle 30 is a "full height" secure receptacle 30, wherein the width and depth of the secure receptacles may vary. Secure receptacle 30 may include a lid 32 movably coupled to the body 34 and, in certain embodiments, the lid 32 is hingedly attached to the body 34 at a back edge of the body 34.

A front cover has been removed from the body 34 to expose certain internal elements, including a processor 219 and a lid-securing actuator 217 that is configured to engage a latching feature such as the hook 211-1 of the lid 32. In certain embodiments, the lid-securing actuator 217 is configured to engage and retain the hook 211-1 so as to secure the lid 211 in a closed position. The processor 219 is operatively coupled to the lid-retaining actuator 217 and the interface connector 110 (not visible in FIG. 4). When the lid 211 is closed, the lid 211 cooperates with the body 213 to define a compartment 215. After the lid is closed, any items placed in the compartment 215 are secure until the secure receptacle 30 is docked with a receiving station such as a smart carrier 100 and a command is received by the processor 219 through the interface connector 210 to open the lid, whereupon the processor actuates the lid-retaining actuator 217 which releases the hook 211-1 and allows the lid 211 to open. In certain embodiments, the secure receptacle 201 may comprise a biasing element, such as a spring, that urges the lid 211 to move away from the closed position to an open position such that the lid 32 will self-open upon release of the hook 211-1 by the lid-securing actuator 217.

Figure 5B:
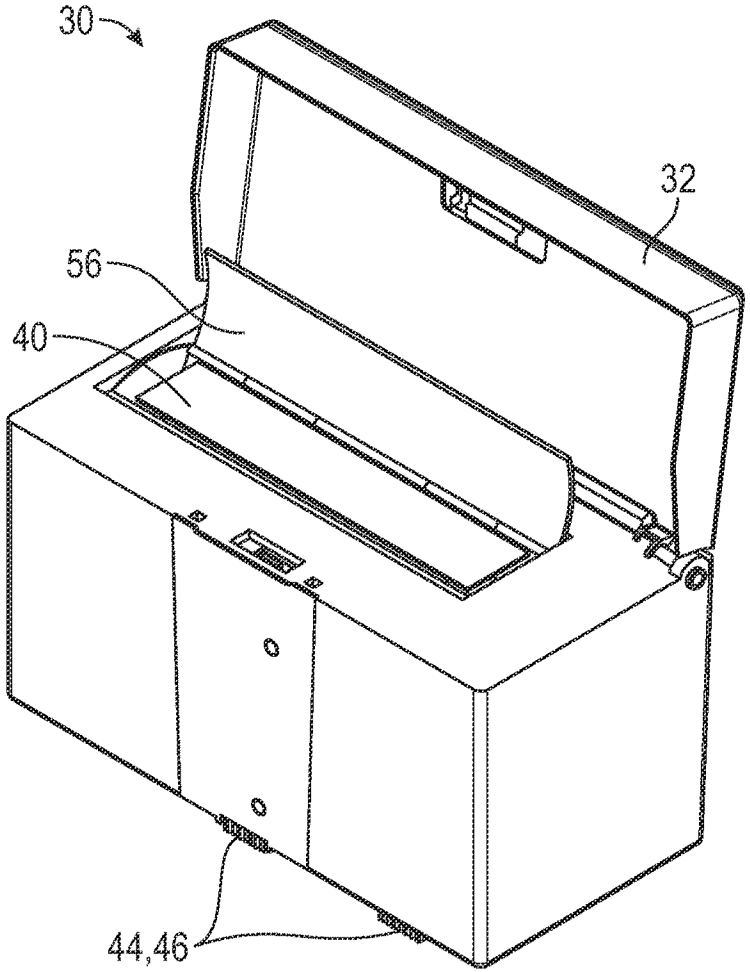
FIGS. 5A and 5B depict an example single access secure receptacle with locking lid for single item dispense, according to various aspects of the subject technology.
Figure 5A:
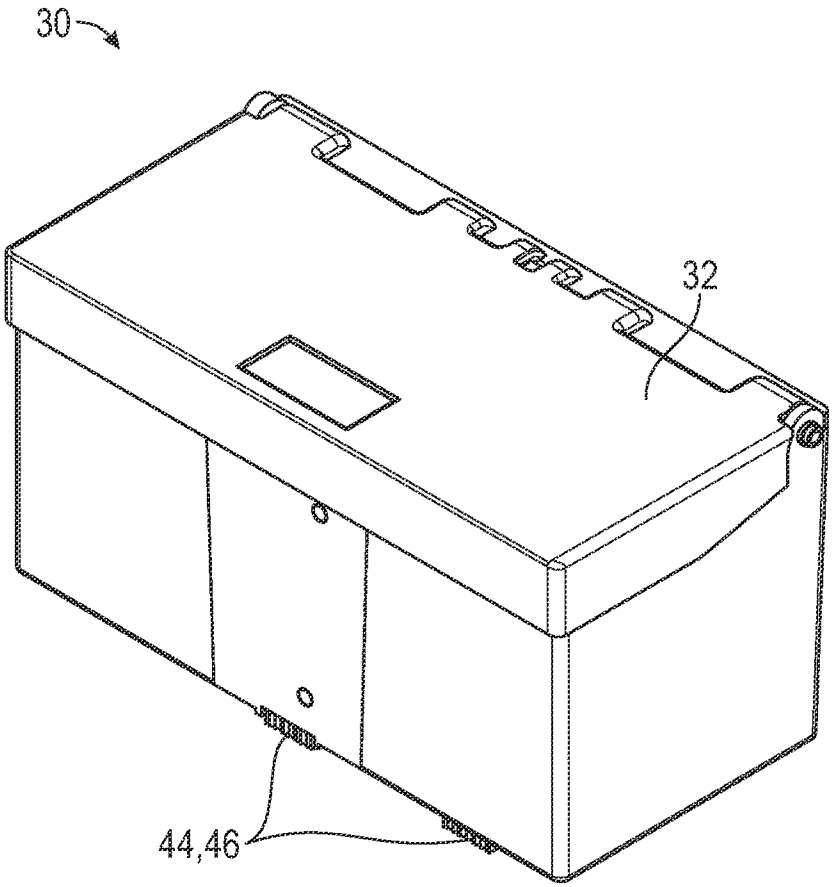

FIGS. 5A and 5B depict an example single access secure receptacle 30 with locking lid for single item dispense, according to various aspects of the subject technology. In the depicted example, secure receptacle 30 can be loaded in a mobile smart carrier 100 or plugged into the drawer 20 as described previously. Secure receptacle 30 includes a rotating pocket-based drum mechanism 40 that is capable of a first-in-first-out (FIFO) dispensing management of items. The pockets of drum mechanism may be loaded with the same items or loaded with different items (e.g. pre-loaded syringes). Secure receptacle 30 may have one or more electrical connectors 42 disposed on an outer portion of the body 34 that interface with connectors 110 of carrier 100 or drawer 20 when secure receptacle 30 is docked therewith. A first connector 44 may provide power and electronic communication to a lid latch module 48 that operates release of the lid 32. A second connector 46 may provide power and/or communications capabilities to other components within secure receptacle 30, as will be described below. According to various implementations, connectors 44 and 46 facilitate docking the secure receptacle with a docking station and communicating with a processor of the docking station.

Figure 6B:
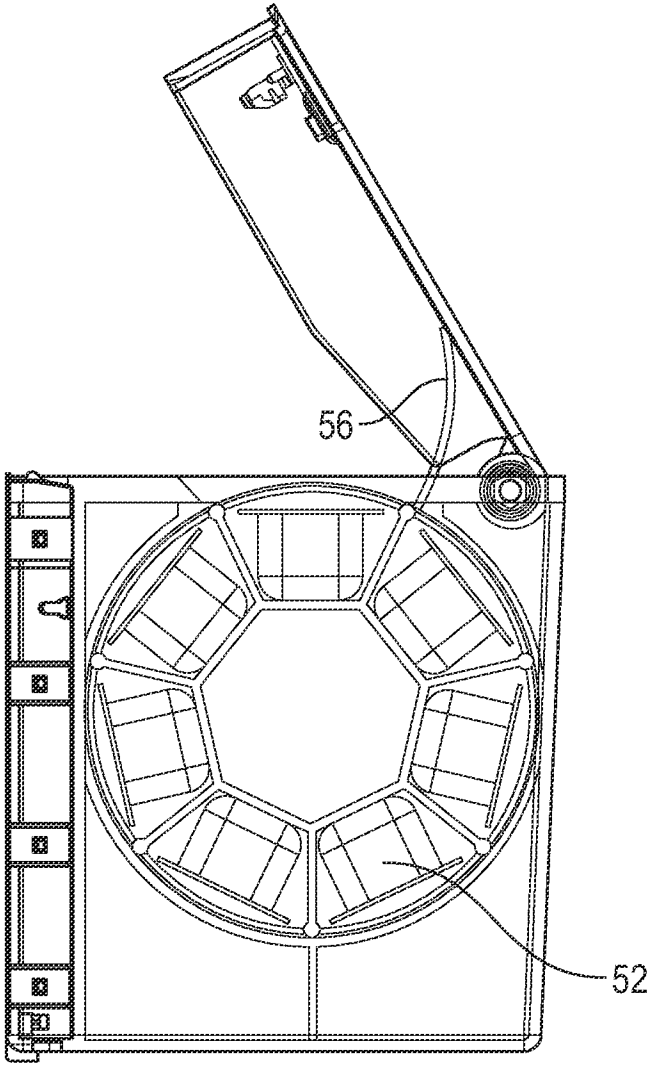
FIGS. 6A to 6D depict a cutaway side view of a secure receptacle, including example opening and closing sequences of the secure receptacle, according to various aspects of the subject technology.
Figure 6A:
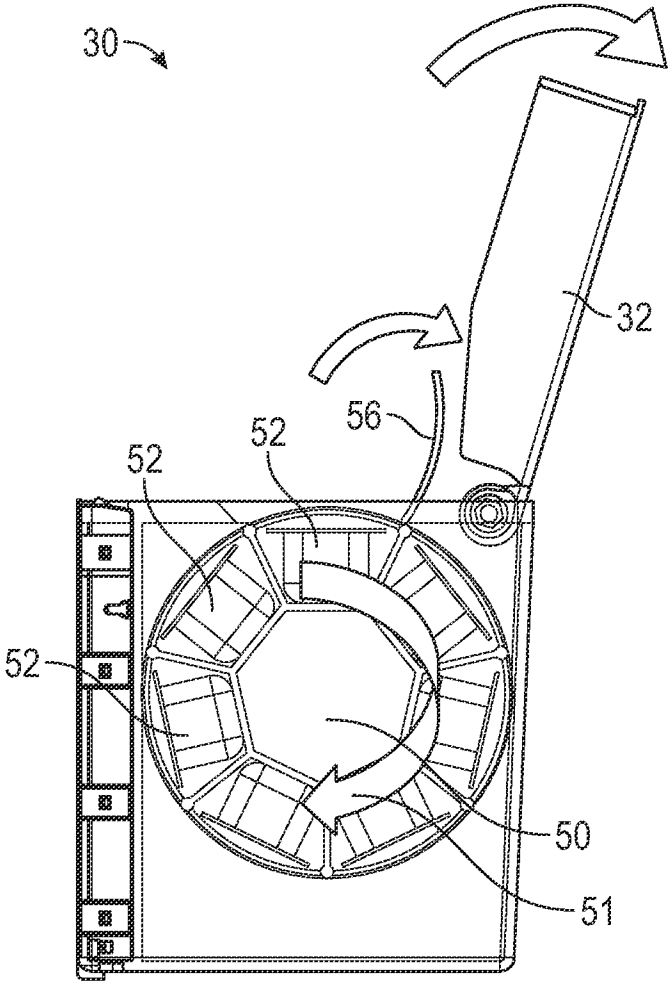

FIGS. 6A to 6D depict a cutaway side view of secure receptacle 30, including example opening and closing sequences of the secure receptacle 30, according to various aspects of the subject technology. FIG. 6A depicts an example opening of lid 32. A vertically-aligned drum or carousel 50 is disposed within secure receptacle's compartment. Carousel 50 includes a plurality of secure pockets or containers 52 that are horizontally disposed around a rotational axis 53 of the vertically-aligned carousel 50. Each secure container 52 may include a securable lid 56 preventing access to the secure container when the securable lid is in a closed position (shown open in FIG. 5). In some implementations, carousel 50 is configured to lock in a secured position in which each securable lid of each of the plurality of secure containers in the closed position.

During loading, carousel 50 may include one or more sensors (not shown in FIG. 6) which secure receptacle 30 uses to rotate to an empty pocket and the main lid 32 springs open followed by the pocket lid. In an example, a technician loads an item into the pocket 52 and the item name/description and expiration date are recorded onto an on-board memory (not shown in FIG. 6). A processor associates the item with this sensed pocket position. Carousel 50 rotates (51) to the next empty pocket and the sequence is repeated until all of the pockets are filled. Once filled, lid 32 is securely closed and secure receptacle 32 is ready for dispense and/or transport. A pharmacy technician may load secure receptacle 30 into ADM 12. A processor of ADM 12 recognizes the location of secure receptacle 30 (e.g. in which drawer 20 and/or predetermined location within drawer 20) and its contents per carousel pocket 52, and secure receptacle 30 is ready for dispensing from ADM 12. In various implementations, a processor of secure receptacle 30 (discussed further below) is configured to recognize the oldest item (by date code) and deliver this item thereby managing the item delivery by FIFO. When a caregiver requests an item that is contained in the secure receptacle, the motorized carousel 50 rotates to the appropriate position ready for dispense. Once carousel 50 is in the correct position, the lid 32 "pops" open followed by the carousel lid 56.

Figure 6D:
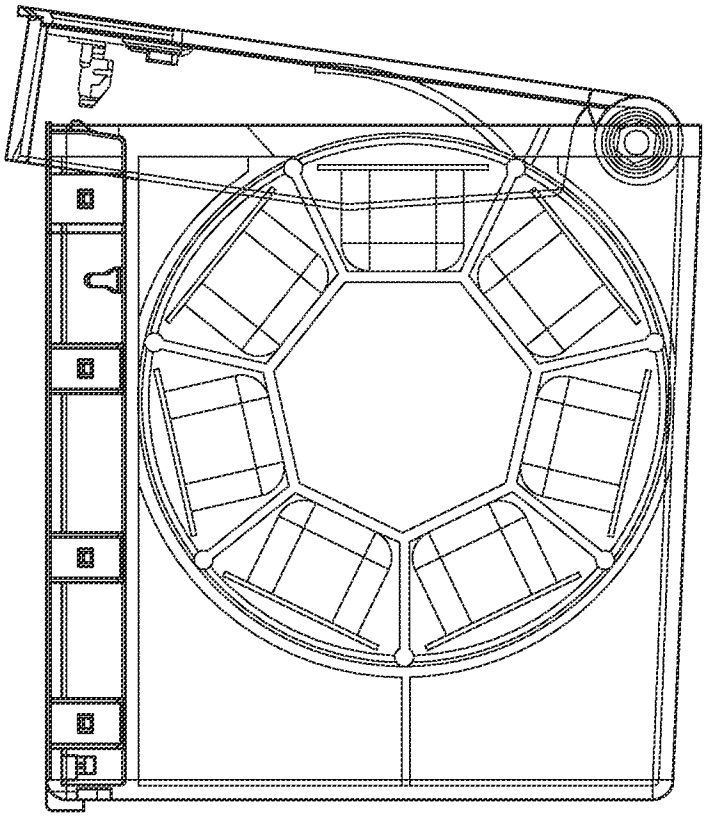
Figure 6C:
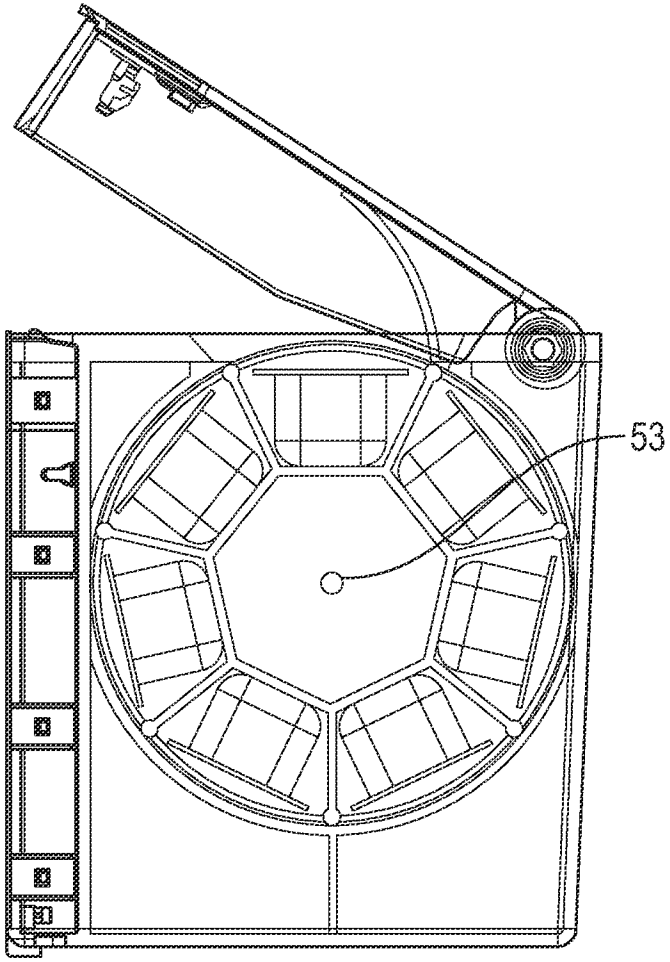

FIGS. 6B to 6D depict an example closing sequence for closing the lid of a secure receptacle, according to various aspects of the subject technology. ADM 12 drawer opens and lid latch module 48 activates and the spring-loaded lid 32 pops open and in-turn the spring-loaded carousel lid 56 pops open. The caregiver retrieves the item and closes the 32 and it latches shut via lid latch module 48. The carousels lid 56 may also closed by closing the lid 32 as shown in FIG. 6.

Figure 7:
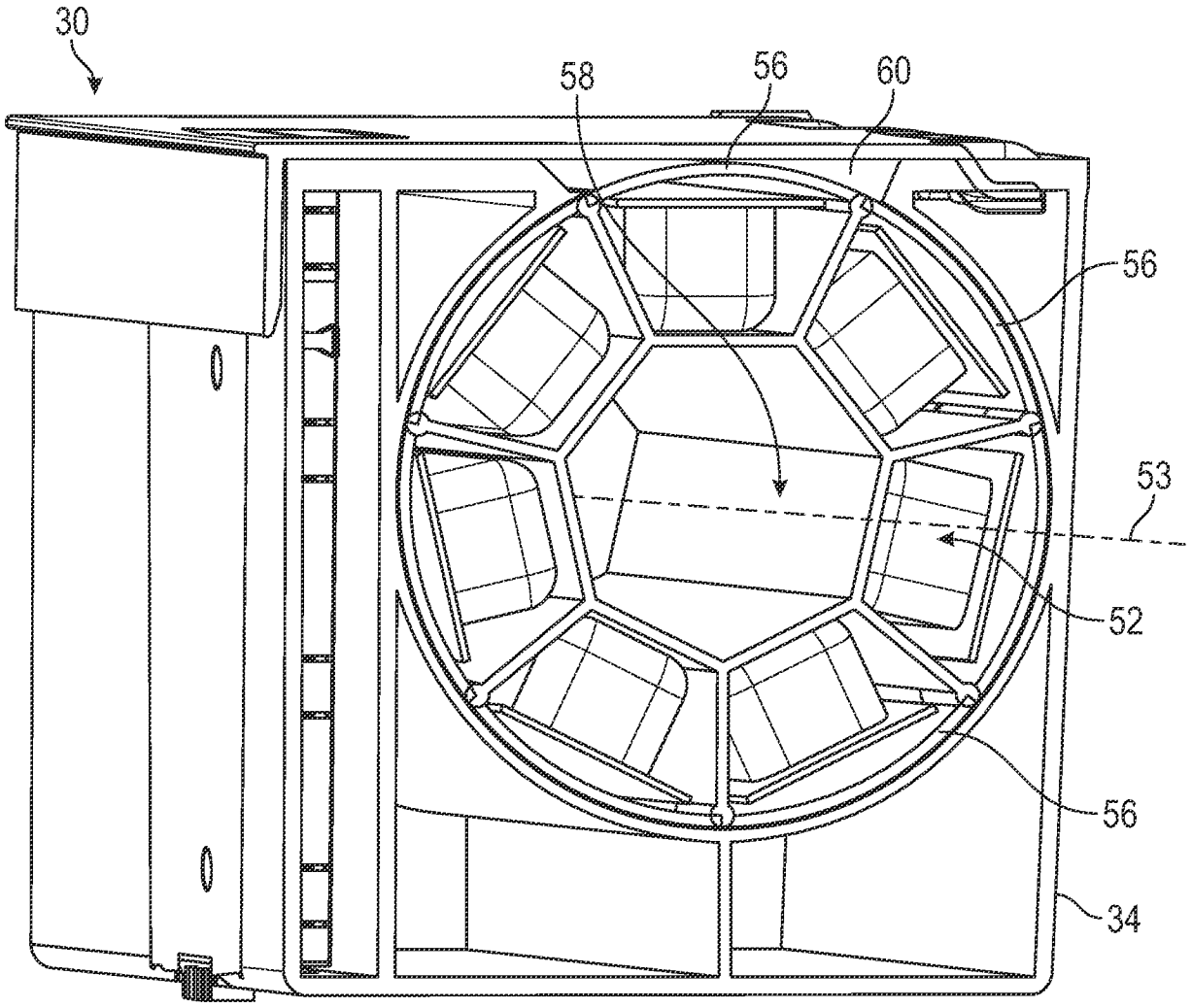
FIG. 7 depicts a cut-away view of an example a secure receptacle with each container lid being held in position by a curved inner wall surrounding the carousel, according to various aspects of the subject technology.

FIG. 7 depicts a cut-away view of an example secure receptacle 30 with each container lid 52 being held in position by a curved inner wall surrounding the carousel, according to various aspects of the subject technology. According to various implementations, each lid 56 has a curvature that substantially matches the curvature of the outer perimeter of the curvature of carousel 50 (e.g. less than 5% tolerance). In this regard, carousel 50, each of its containers 52, and lids 56 are assembled together such that, from a side view of carousel 50, lids 56 collectively form a circle around carousel 50. Body 34 includes an inner structure 58 that encloses the outer perimeter of carousel 50, forming a circular or otherwise cylindrical chamber therein in which carousel 50 is disposed, held and contained. An opening 60 (or "access window") is formed through a top portion of body 34 and through inner structure 58. Opening 60 may have a width and length dimension that is larger or slightly larger (e.g. less than 5% tolerance) than the same dimensions of lid 56 to allow lid 56 passage therethrough when opened. In this regard, the curved wall of inner structure 58 maintains each lid 56 in a closed position during rotation of carousel 50. Is some implementations, each lid 56 may be spring activated such that the lid is biased to automatically open without any downward pressure applied to a top of the lid, and the lids are held closed by the curved wall until a respective lid reaches opening 60. At that point, the respective lid 56 is allowed to spring open through opening 60, providing that a lid 32 of secure receptacle 30 does not impede the opening (see FIG. 6).

As depicted in FIG. 7, carousel 50 and containers 52 may be a single structure formed by molded plastic. Each container 52 may share its walls around carousel 50 with the adjacent containers 52. In some implementations, the floors of each container or pocket 52 may collectively form a polygon (about rotational axis 53) with as many sides as the number of containers or pockets 52 within carousel 50. For example, where there are seven containers, the floors of the containers may form a heptagon, where there are six containers, the floors may form a hexagon, etc.

Figure 8:
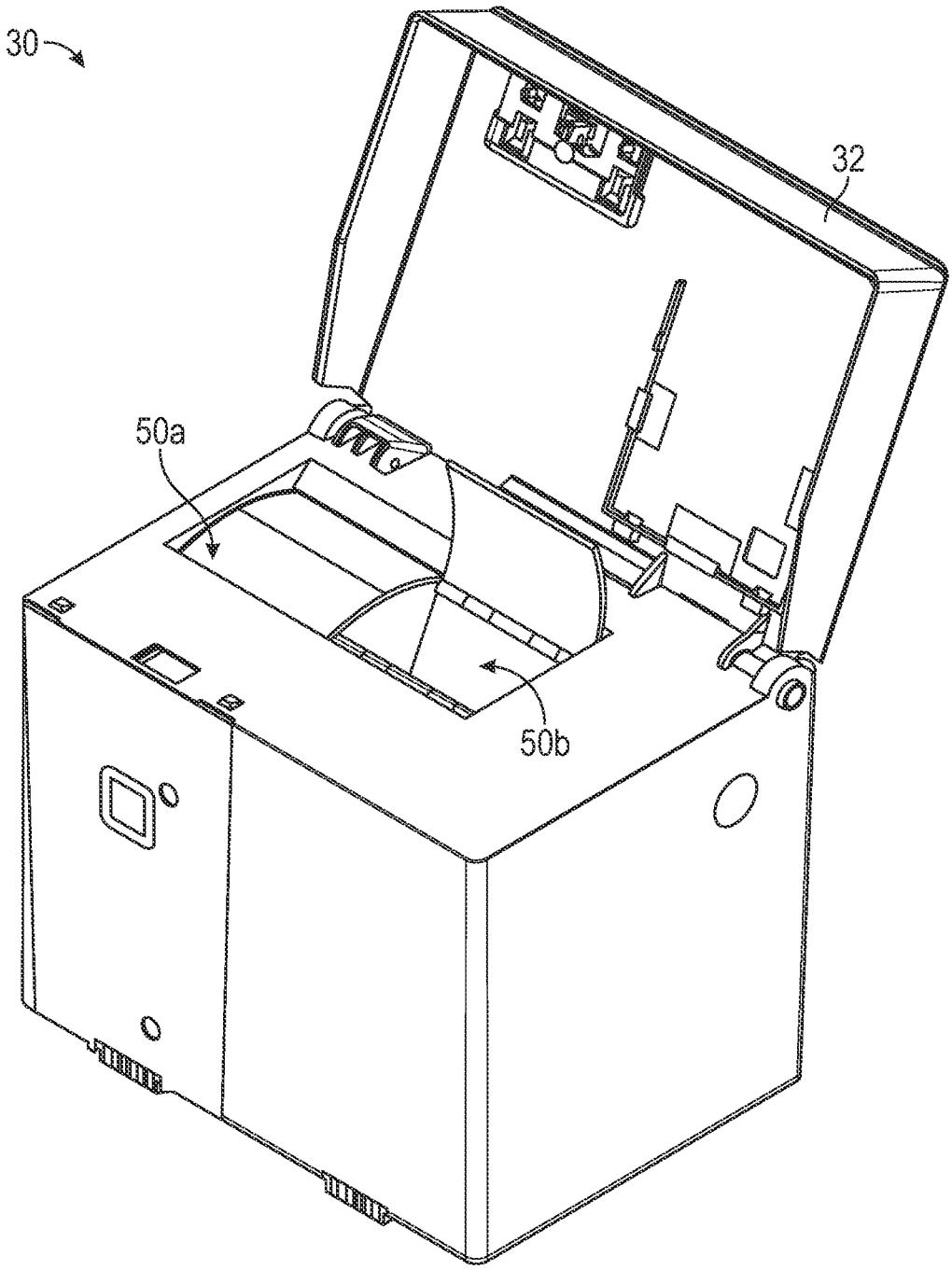
FIG. 8 depicts an example secure receptacle with two carousels side-by-side, according to various aspects of the subject technology.

FIG. 8 depicts an example secure receptacle 30 with two carousels side-by-side, according to various aspects of the subject technology. Similar to the foregoing concepts, a secure receptacle 30 may include side-by-side carousels 50*a* and 50*b*. Carousels 50*a* and 50*b* may be horizontally (e.g. along axis 53) offset by half a pocket (secure container 52), allowing access to only one pocket at a time. For example, as depicted in FIG. 8, offset pockets—or pockets out of phase—allow the access to a pocket 52*a* while its adjacent pocket's 52*b* lid is blocked.

Figure 9:
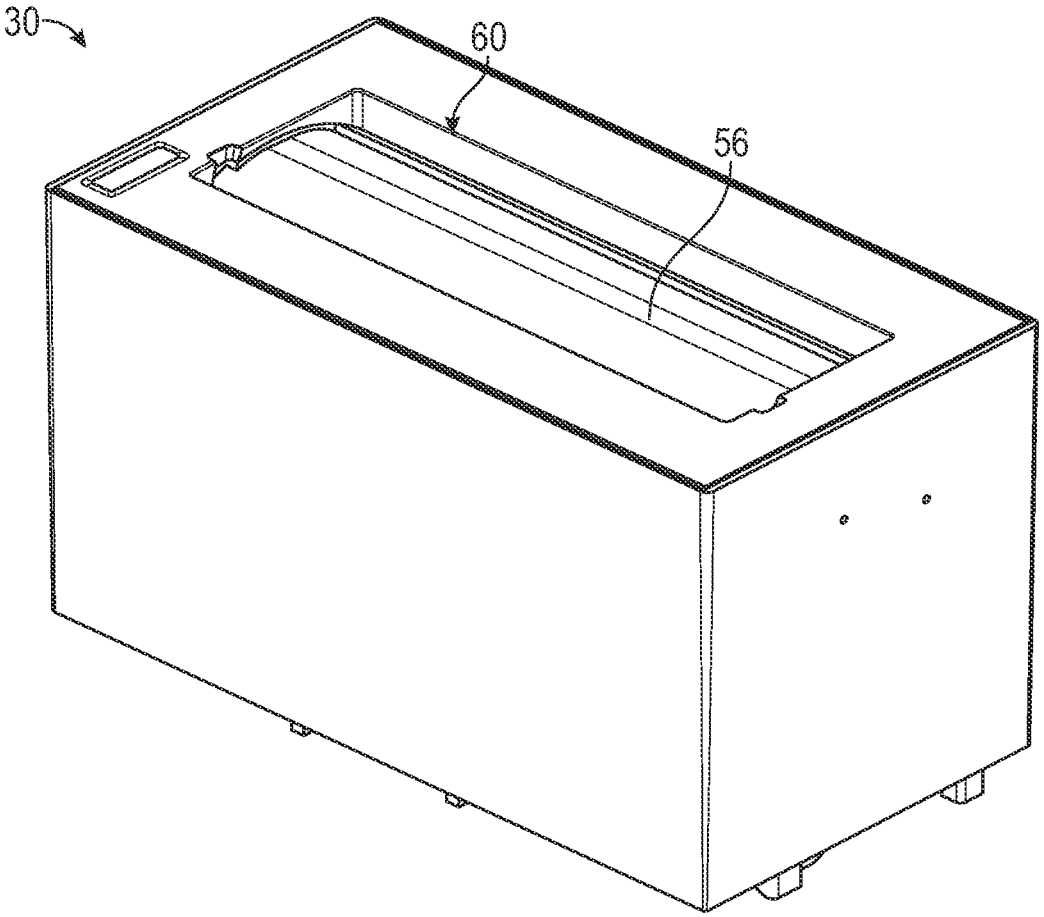
FIG. 9 depicts an example direct access secure receptacle with access controlled by each container's locking lid, according to various aspects of the subject technology.

FIG. 9 depicts an example direct access secure receptacle 30 with access controlled by each container's 52 locking lid 56, according to various aspects of the subject technology. A secure receptacle 30 may be used to transport items from a pharmacy to ADM 12. The secure receptacle 30 can be loaded while in the pharmacy using a carrier 100, or can be loaded directly at ADM 12. The depicted receptacle is a rotating pocket-based carousel 50 mechanism that is capable of a first-in-first-out (FIFO) dispensing management of the same item. In some implementations, secure receptacle 30 may be loaded with different items (e.g. pre loaded syringes). Secure receptacle 30 may have a single connector that interfaces with the drawer of ADM 12. The depicted example also does not have an outer lid 32, instead using individual locking compartment lids 52 to secure the individual contents.

Figure 10:
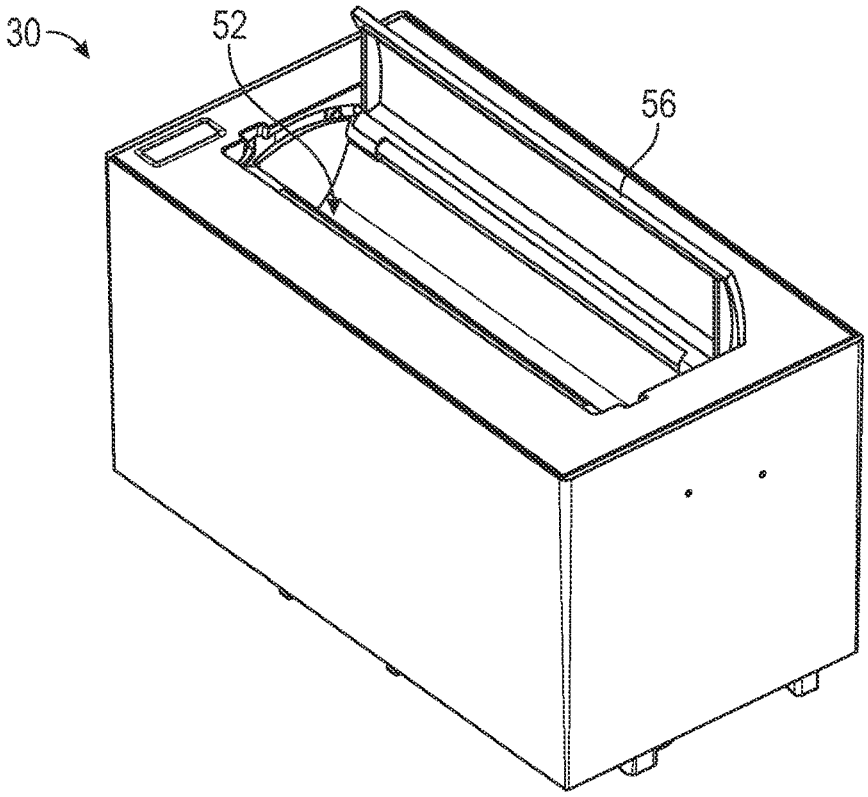
FIG. 10 depicts the example direct access secure receptacle with locking lid in the open position, according to various aspects of the subject technology.

FIG. 10 depicts the example direct access secure receptacle with locking lid 56 in the open position, according to various aspects of the subject technology. Secure receptacle 30 does not require the closing of a separate lid 32 in order to retrieve items from different compartments. Rather, the carousel's compartment lids 56 are individually latched and locked. Therefore, the carousel 50 can rotate to the desired item's compartment and its lid will pop open. The item is retrieved and the caregiver closes lid 56 and the lid is latched shut.

Figure 11:
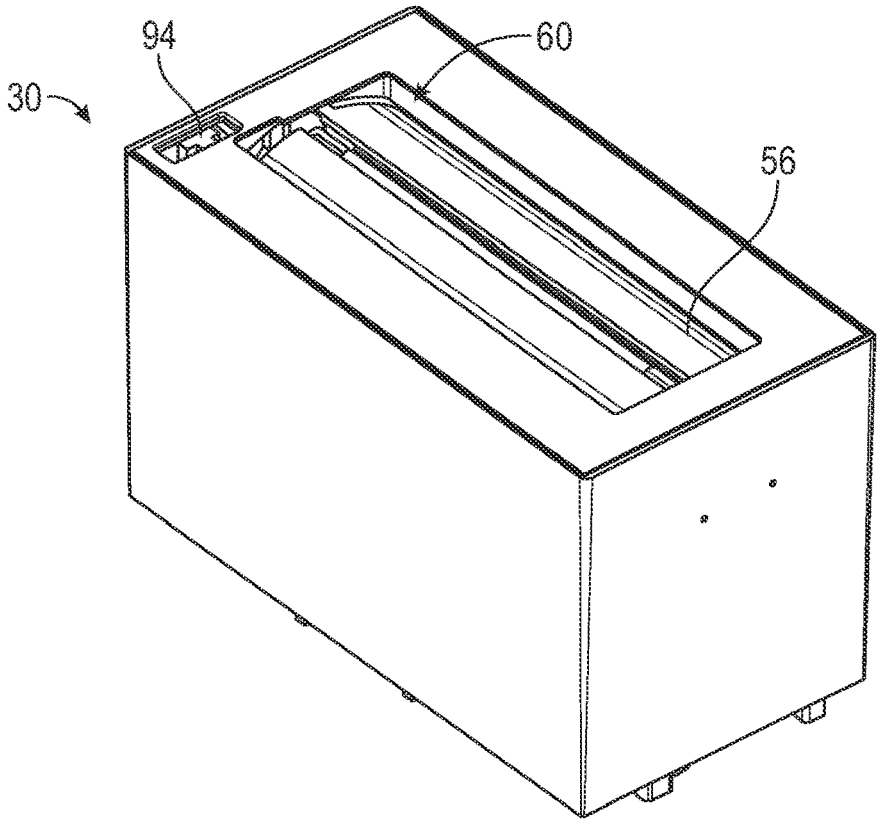
FIG. 11 depicts the example direct access secure receptacle with the lid closed and carousel in an offset position, according to various aspects of the subject technology.

FIG. 11 depicts the example direct access secure receptacle with the lid closed and carousel in an offset position, according to various aspects of the subject technology. In some implementations, after lid 56 is closed, carousel 50 may move to the offset position. In this regard, carousel 50 rotates a distance equal to half a compartment and stops so that lids 56 are blocked by the access window 60. In the depicted example, secure receptacle 30 is in a parked position wherein carousel is in the offset position, a default position for transport of secure receptacle between docking locations (e.g. between the pharmacy and ADM 12).

Figure 12A:
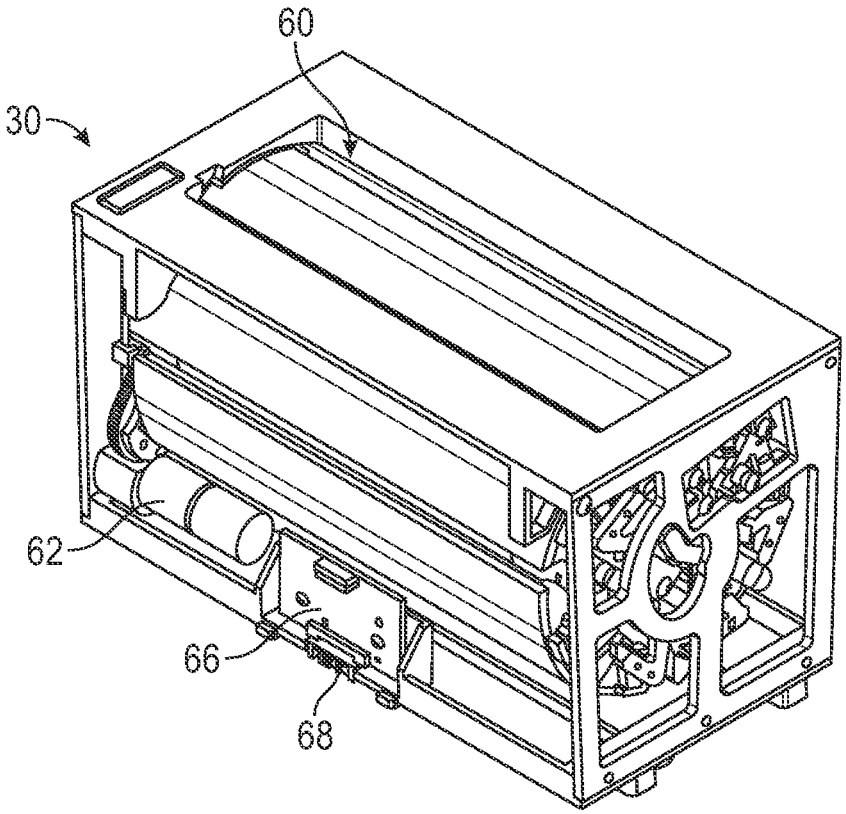
FIGS. 12A and 12B depict an interior view of an example secure receptacle, according to various aspects of the subject technology.
Figure 12B:
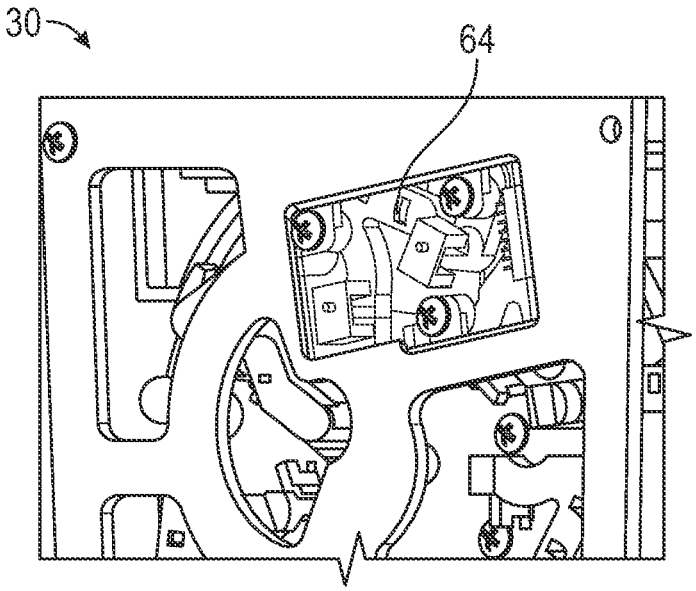

FIGS. 12A and 12B depict an interior view of an example secure receptacle 30, according to various aspects of the subject technology. According to various implementations, secure receptacle 30 includes a rotating carousel assembly 50 that is driven by an actuator 62 (including e.g. an electro mechanical motor). Actuator 62 can rotate carousel 50 in either direction. A circuit module 64 (including e.g. a printed circuit board assembly (PCBA)) houses one or more sensors that detect if the compartment lid 56 is closed and locked. A second circuit module 66 may mount a connector 68 that interfaces with the drawer tray assembly of ADM 12 or with carrier 100.

Figure 13:
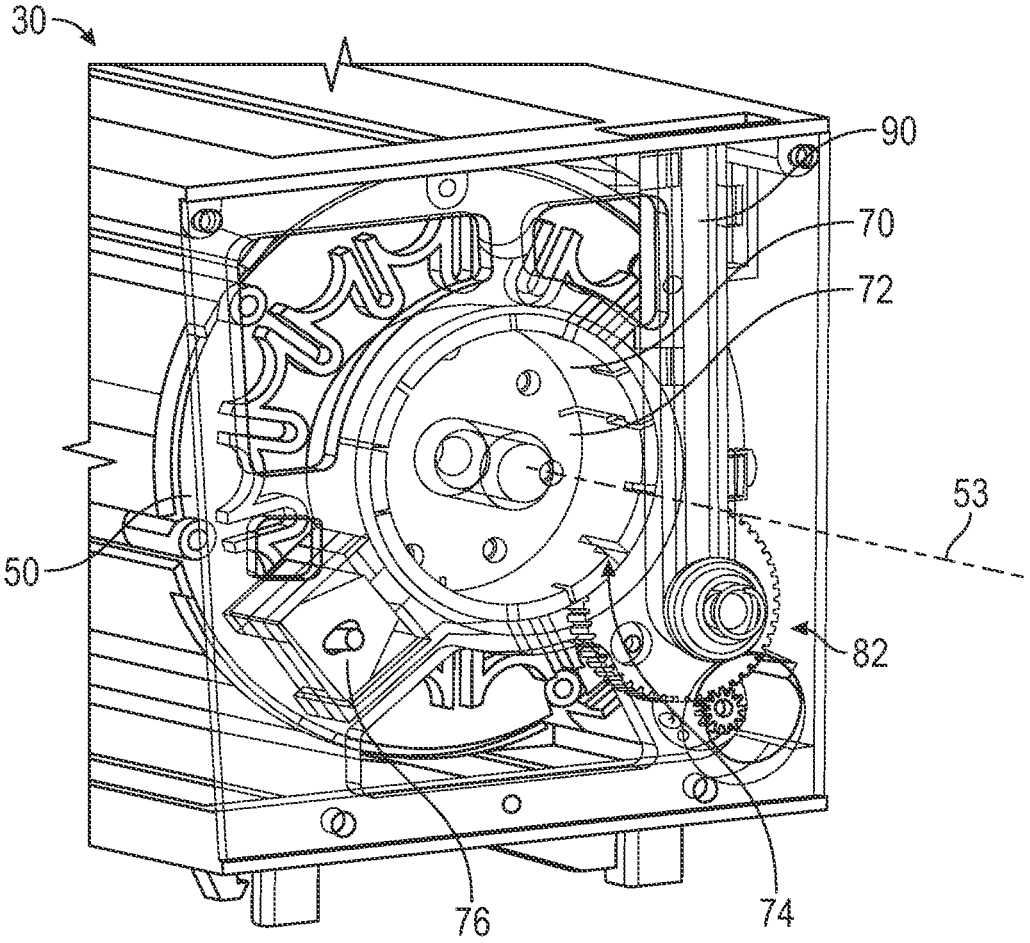
FIG. 13 depicts an interior side view of an example secure receptacle and carousel, according to various aspects of the subject technology.
Figure 14A:
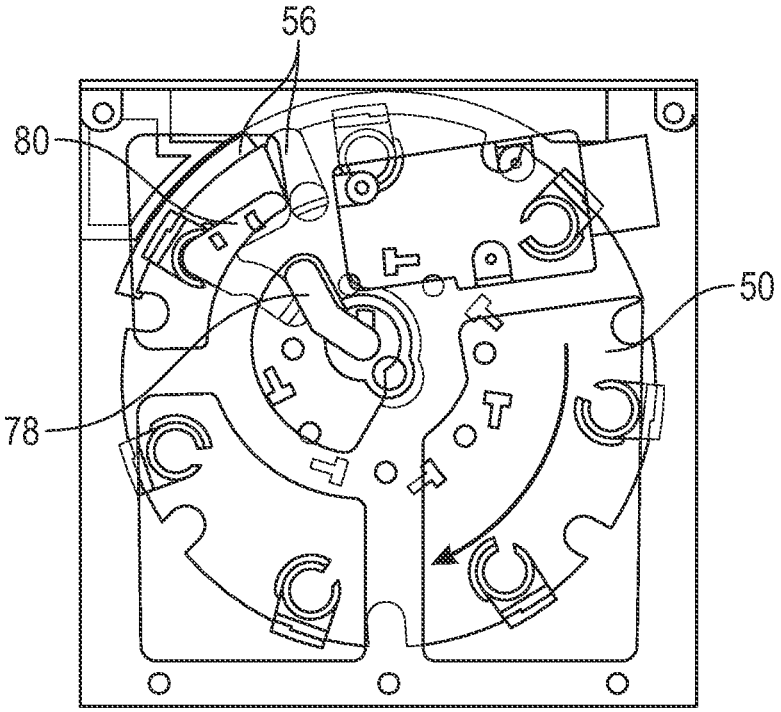
FIGS. 14A through 14D depict a first example sequence of steps for opening a compartment lid of the disclosed secure receptacle, according to various aspects of the subject technology.
Figure 14B:
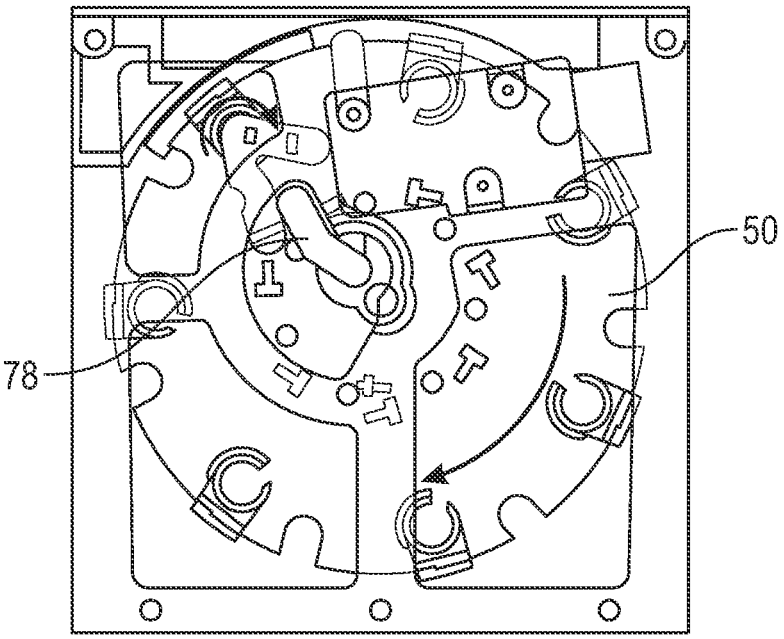
Figure 14C:
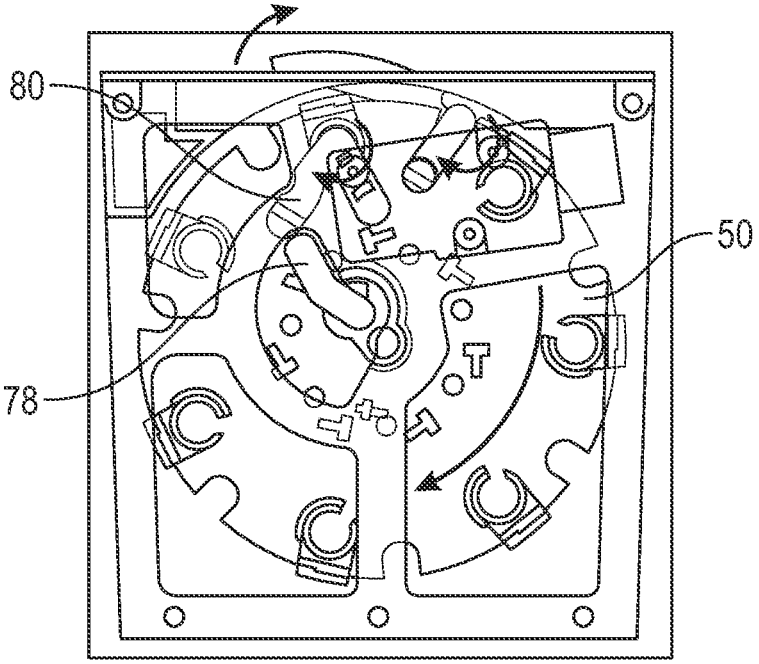
Figure 14D:
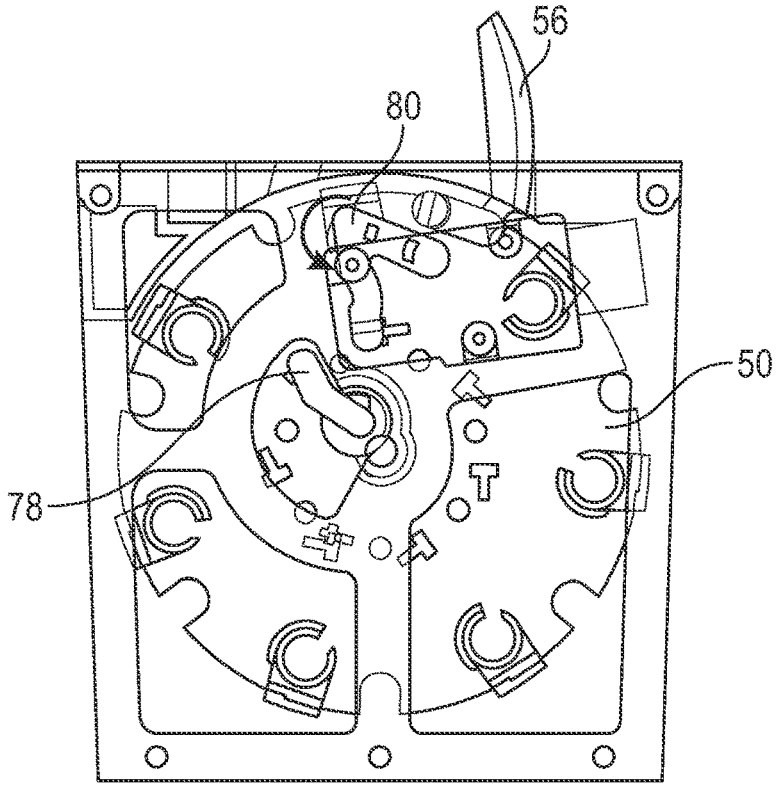

FIG. 13 depicts an interior side view of an example secure receptacle and carousel 50, according to various aspects of the subject technology. According to various implementations, carousel 50 includes an external collar wall 70 affixed to a side of carousel 50 extending horizontally about axis 53. Collar wall 70 may coupled or integrated with a collar base 72 and includes multiple slots 74 within collar wall 70 about axis 53. Slots 74 may be of different lengths and/or widths. In this regard, secure receptacle 30 may further include one or more reflective sensors 76 for determining a position of carousel 50. Reflective sensor(s) 76 includes a light beam transmitter directed at an outer or exterior side of collar wall 70. Sensor(s) 76 determines the position of carousel 50 by way of detecting an amount of light passing through slots 74. Since each slot has a different light transmission characteristic a processor of circuit module 64 (or similarly situated processor) may determine the location of carousel by indexing the detected light transmission from sensor(s) 76 with predetermined positions of carousel 50 stored in an associated memory.

FIGS. 14A through 14D depict a first example sequence of steps for opening a compartment lid 56, according to various aspects of the subject technology. Carousel 50 may include an actuation lever 78 on a side of carousel 50, within an interior of secure receptacle 30, as shown. Each pocket may include a lid 56, as previously described. Carousel may include a plurality of lid latches 80, each operably connected to a respective lid 56 of the secure containers and configured to secure the respective lid 56 in a closed position until actuated by the actuation lever 78 when the vertically-aligned carousel rotates in a first direction 80 past the actuation lever. Each respective lid 56 remains in the closed position while carousel 50 rotates in a second direction, motorized controller 62 (see FIG. 12A) rotates carousel 50 in the second direction until the requested container 52 moves past the opening of secure receptacle, e.g. access window 60, and then rotates carousel 50 in the first direction to actuate the securable lid 56 of the requested container 52 to provide access to an interior of the requested container 52 through access window 60.

For example, in a first step (FIG. 14A), lid 56 is held in place by a lid latch 80. In the depicted example, carousel 50 (including all related assembly portions, e.g. collar 70) rotates clockwise 80 and lid 56 comes in contact with actuation lever 78. In a second step (FIG. 15B), carousel 50 continues to rotate clockwise. Lid latch 80 coming into contact with actuation lever 78 forces lid latch 80 to rotate clockwise and no longer holds lid 56 in place. In a third step (FIG. 15C), as lid latch 80 clears lid 56, lid 56 springs open. Carousel 50 continues to rotate clockwise due to contact with actuation lever 78. In a fourth step (FIG. 15D), carousel 50 stops rotating once the corresponding compartment is in its accessible position. Lid latch 80 clears actuation lever 78 and counterclockwise to its initial position. At this point lid 56 is fully open.

Figure 15A:
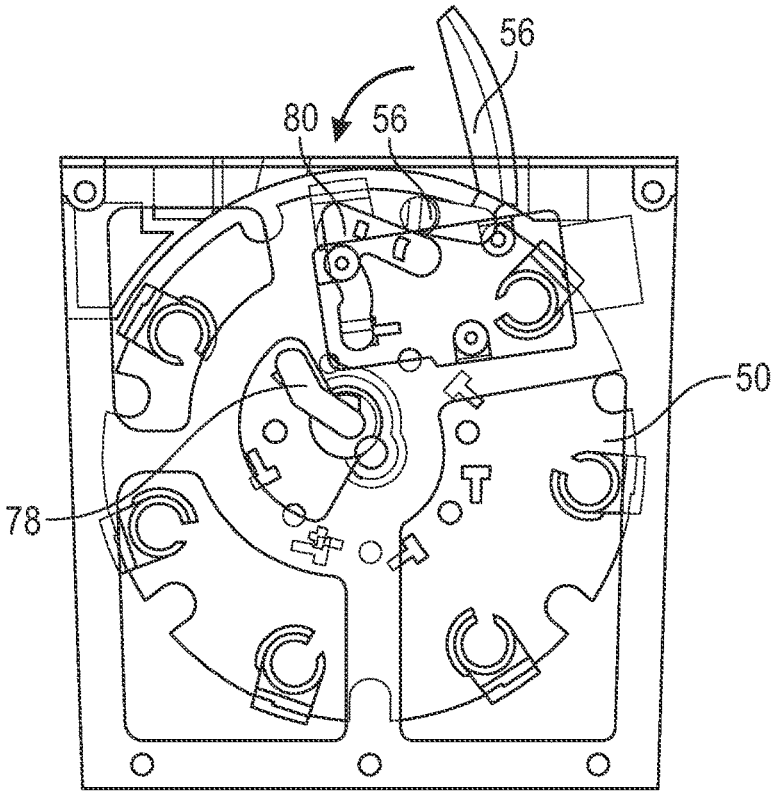
FIG. 15A through 15C depict an example sequence of steps for closing a compartment lid of the disclosed secure receptacle, according to various aspects of the subject technology.
Figure 15B:
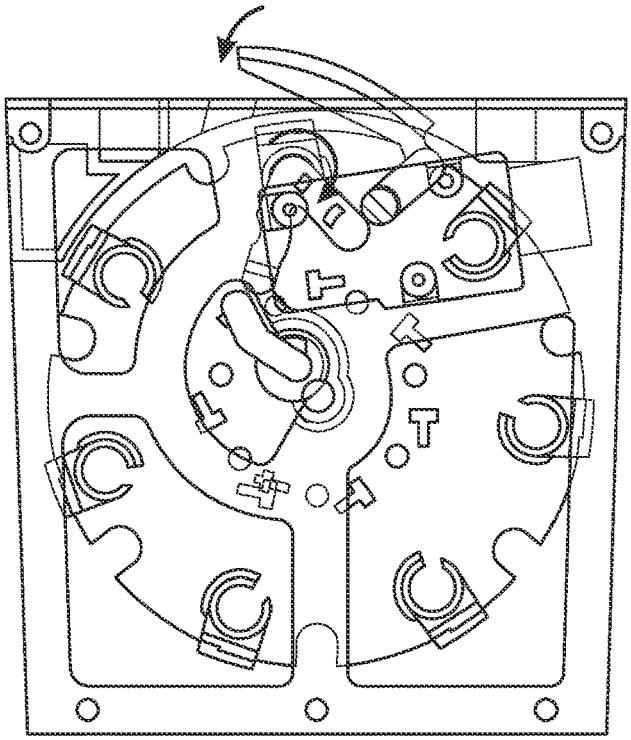
Figure 15C:
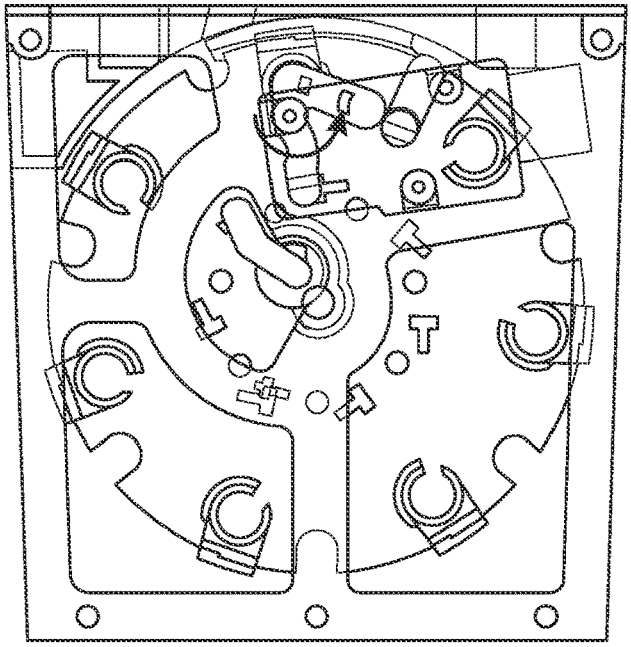
Figure 16A:
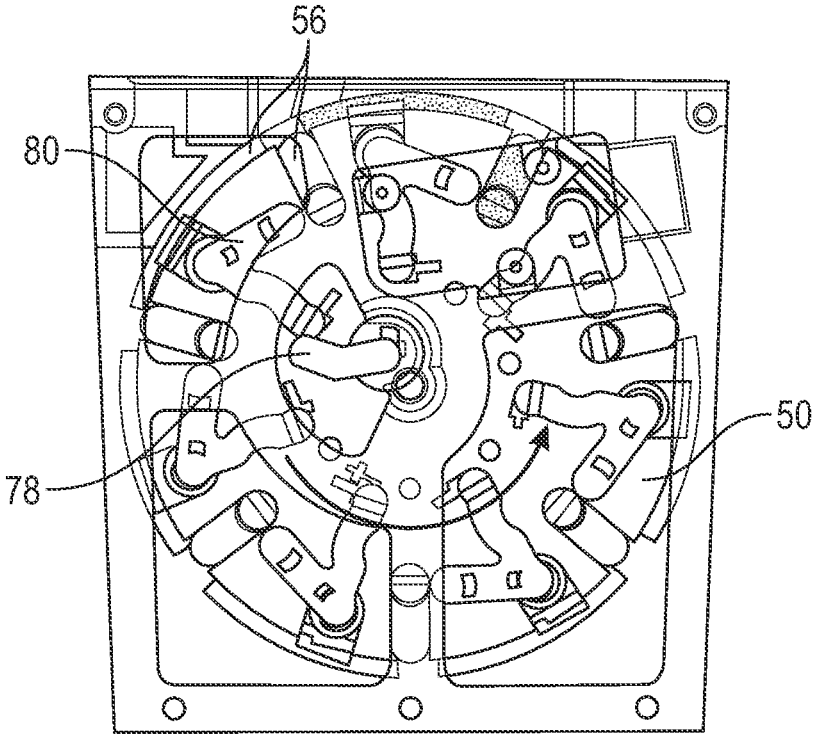
FIGS. 16A through 16H depict a second example sequence of steps for opening a compartment lid of the disclosed secure receptacle, according to various aspects of the subject technology.
Figure 16B:
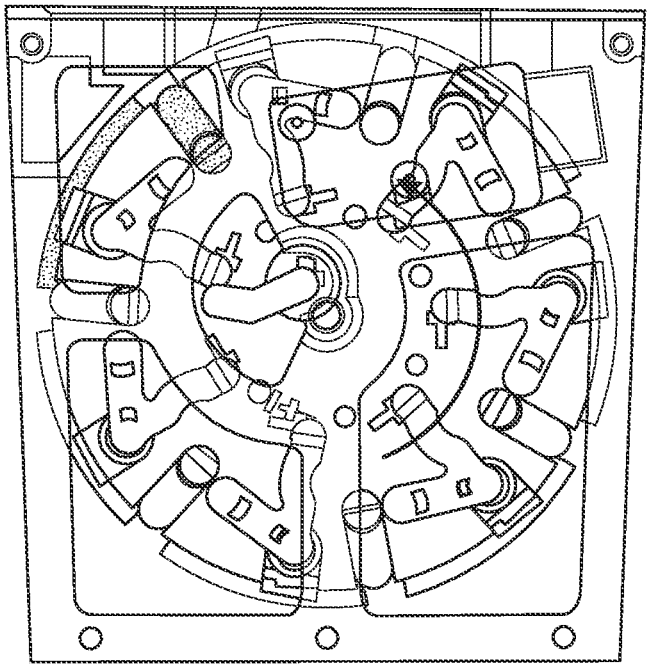
Figure 16C:
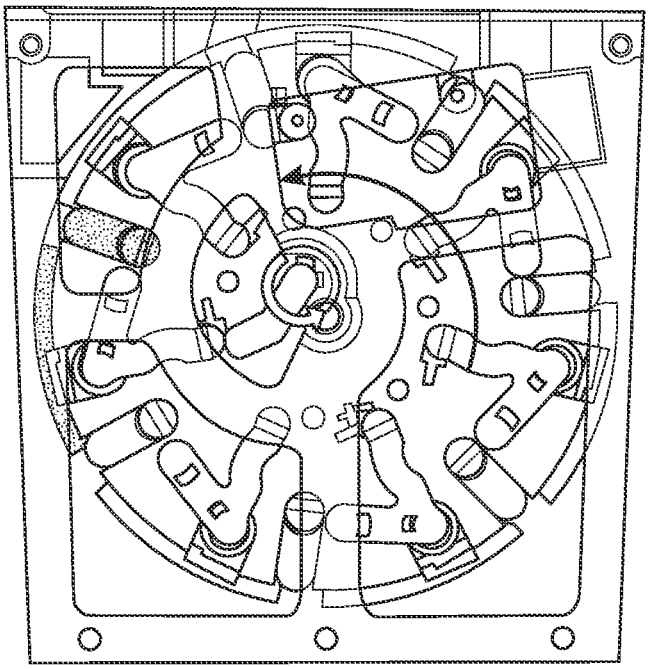
Figure 16D:
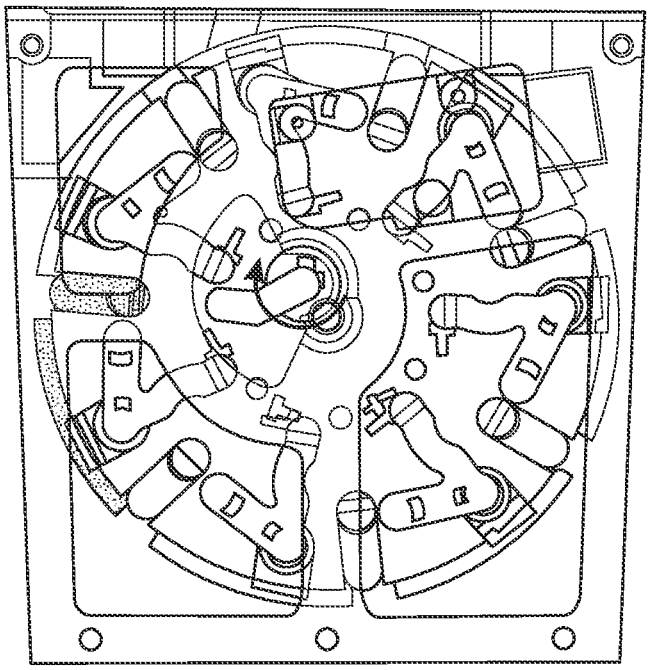
Figure 16E:
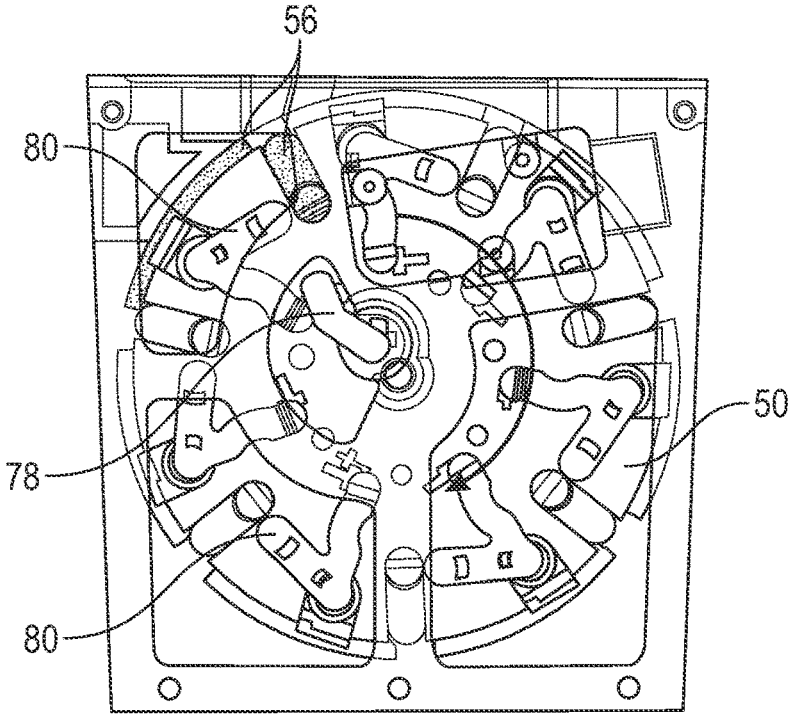
Figure 16F:
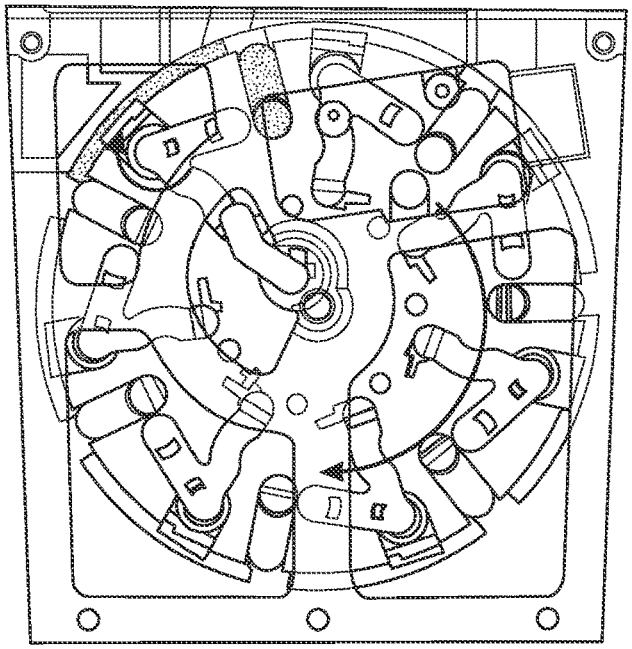
Figure 16G:
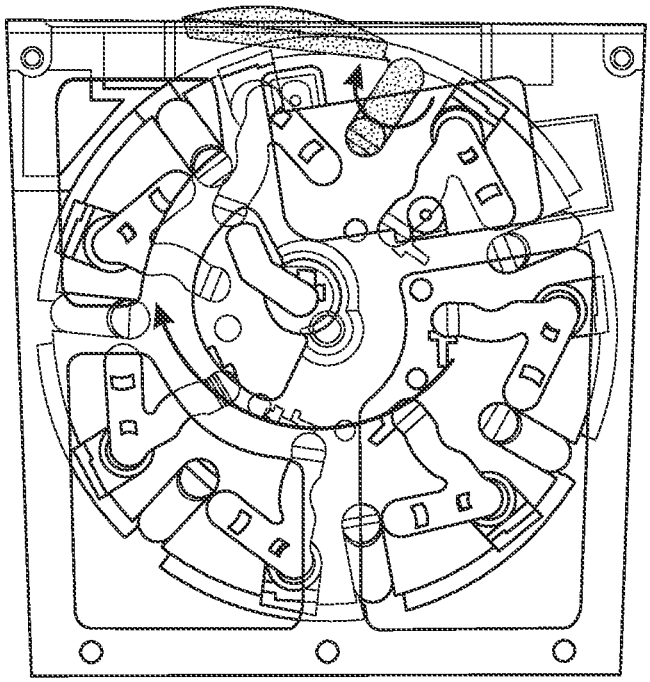
Figure 16H:
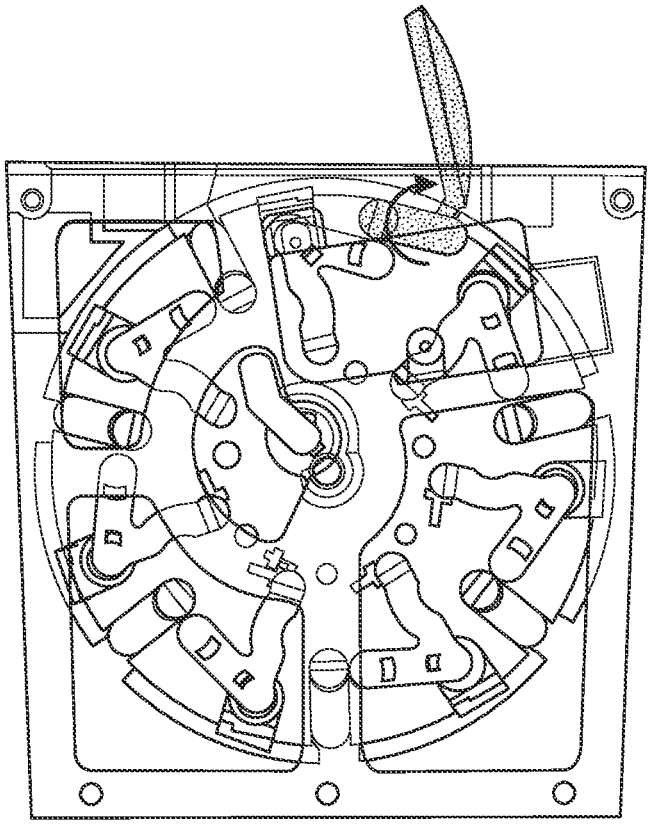

FIG. 15A through 15C depict an example sequence of steps for closing a compartment lid 56, according to various aspects of the subject technology. In a first step (FIG. 15A), lid 56 is pushed closed by a user and rotates, making contact with lid latch 80. In a second step (FIG. 15B), the continued closing of lid 56 rotates lid latch 80 clockwise. In a third step (FIG. 15C), as lid 56 clears lid latch 80, the lid latch's spring rotates counterclockwise and locks lid 56 in place.

FIGS. 16A through 16H depict a second example sequence of steps for opening a compartment lid 56, according to various aspects of the subject technology. In a first step (FIG. 16A), carousel 50 rotates counterclockwise in order to open compartment lid 56. In a second step (FIG. 16B), carousel 50 continues to rotate counterclockwise, and lid latch 80 makes contact with actuation lever 78. In a third step (FIG. 16C), carousel 50 continues to rotate counterclockwise. Lid latch 80 causes actuation lever 78 to rotate counterclockwise. In a fourth step (FIG. 16D), lid latch 80 clears actuation lever 78 and it rotates clockwise, springing back to its initial position. At this point, carousel stops rotating.

In a fifth step (FIG. 16E), carousel 50 rotates clockwise, and lid latch 80 comes in contact with actuation lever 78. In a sixth step (FIG. 16F), after carousel 50 rotate clockwise, and lid latch 80 comes in contact with actuator 78, lid latch 80 begins to rotate clockwise. In a seventh step (FIG. 16G), carousel 50 continues to rotate clockwise, and actuation lever 78 clears lid latch 80 and begins to rotate clockwise and open. In an eighth step (FIG. 16H), carousel 50 stops rotating, and compartment lid 56 completely opens.

Figure 17:
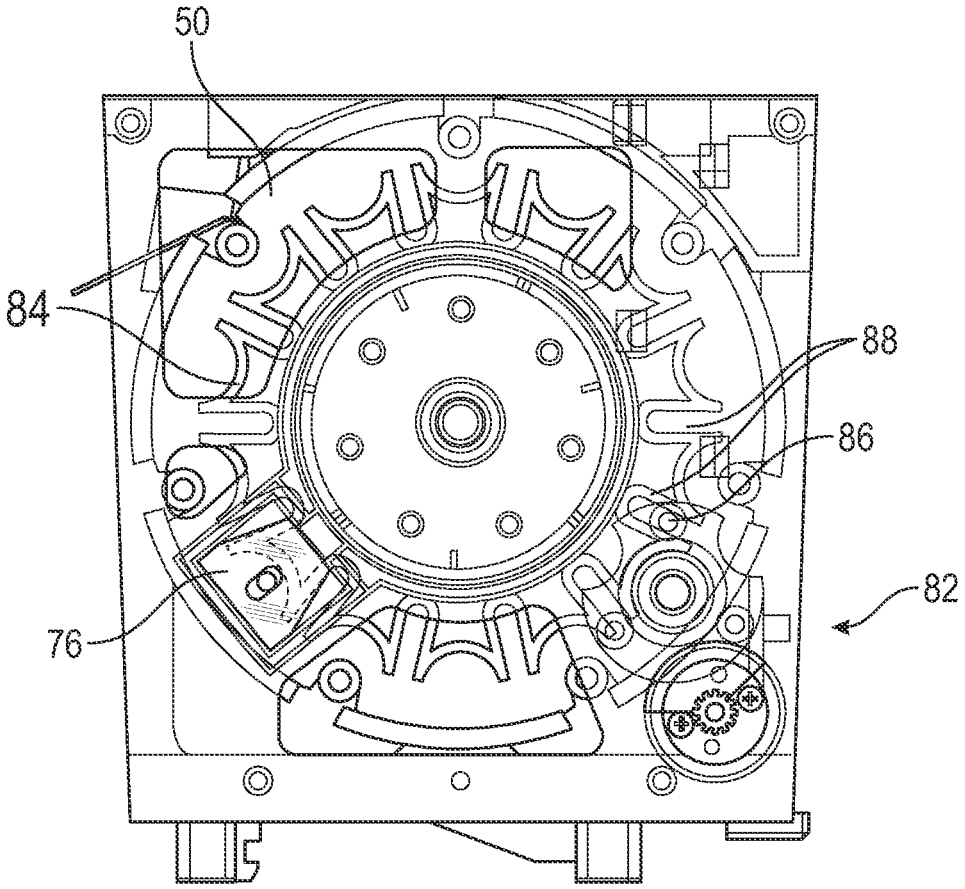
FIG. 17 depicts a mechanical locking drive mechanism for a locking carousel of the disclosed secure receptacle, according to various aspects of the subject technology.

FIG. 17 depicts a mechanical locking drive mechanism 82 for locking carousel 50, according to various aspects of the subject technology. An indexing carousel drive wheel 84 may be coupled to carousel 50 and configured to advance the carousel 50 one-half a compartment at a time. When carousel 50 is in the secured position, with each securable lid of each of the plurality of containers in the closed position, two of the securable lids are at least partially blocked by the top cover opening 60.

Mechanical locking drive mechanism 82 may be configured to prevent the carousel 50 from advancing when the carousel is in a secured position. In some implementations, locking drive mechanism 82 has one or more pins 86 that reach into a slot 88 of carousel 50 to advance the carousel one-half compartment at a time. In this position, the Carousel may be mechanically parked for secure transport.

Figure 18:
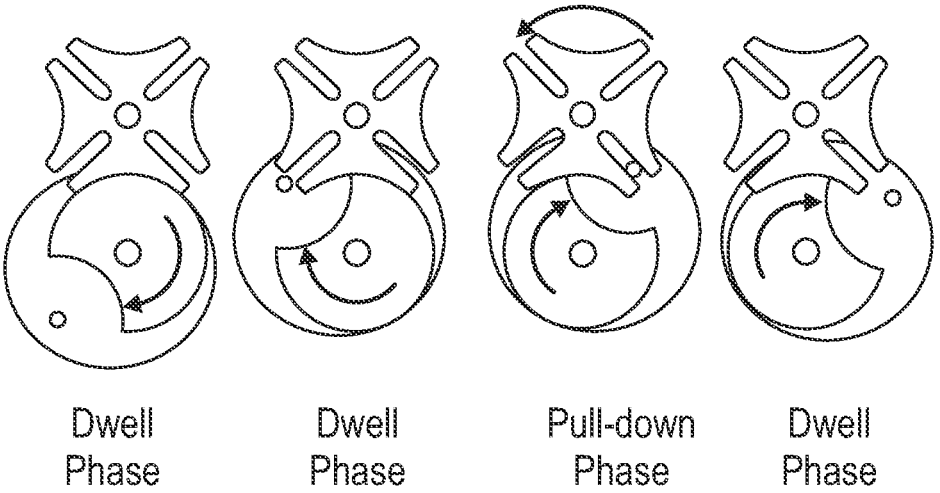
FIG. 18 depicts a Geneva mechanism for locking a carousel of the disclosed secure receptacle, according to various aspects of the subject technology.

FIG. 18 depicts a Geneva mechanism for locking carousel 50, according to various aspects of the subject technology. In some implementations, mechanical locking mechanism 82 may include a Geneva mechanism. The Geneva mechanism translates continuous rotation into an intermittent rotary motion. As depicted in FIG. 17, In a standby/transport position, the Geneva mechanism driver wheel is parked in the drive wheel's dwell position and carousel 50 is stopped at the one-half compartment position, with compartment lids 56 blocked by a top cover perimeter forming the opening 60 to the secure receptacle 30 compartment. According to various implementations, opening 60 is smaller than a perimeter of the body of secure receptacle 30.

With brief reference back to FIGS. 11 and 13, secure receptacle 30 may further include a locking arm 90 extending from an access area 92 adjacent the opening 60 to the compartment to the mechanical lock 82. Locking arm 90 may prevent indexing carousel drive wheel 84 from advancing carousel 50 when the carousel is in the secured position. A locking release tab 94 may be coupled to locking arm 90 at access area 92. Locking release tab 94 may be configured to permanently break free from the locking arm to release carousel 50 from the secured position.

With reference to FIGS. 1 through 18, secure receptacle 30 may be used as a secure means of delivering returned unused items to ADM 12. Secure receptacle 30 may work the same whether dispensing an item or returning an item. Secure receptacle 30 may be used as a return bin, and may be filled with returned items and securely transported to a pharmacy to unload for further disposition. This provides better security during the delivery to the pharmacy. Once filled, secure receptacle 30 can be removed from ADM 12 and replaced with an empty secure receptacle 30. Secure receptacle 30 may be reconciled at the pharmacy, it is not necessary for a highly compensated pharmacist to travel to an ADM 12 to remove contents from a secure receptacle 30. Since removing a filled secure receptacle 30 and replacing it with an empty secure receptacle 30 would be faster than removing individual returned items, the down time for this transaction is less thereby keeping the ADM available for normal use.

Figure 19:
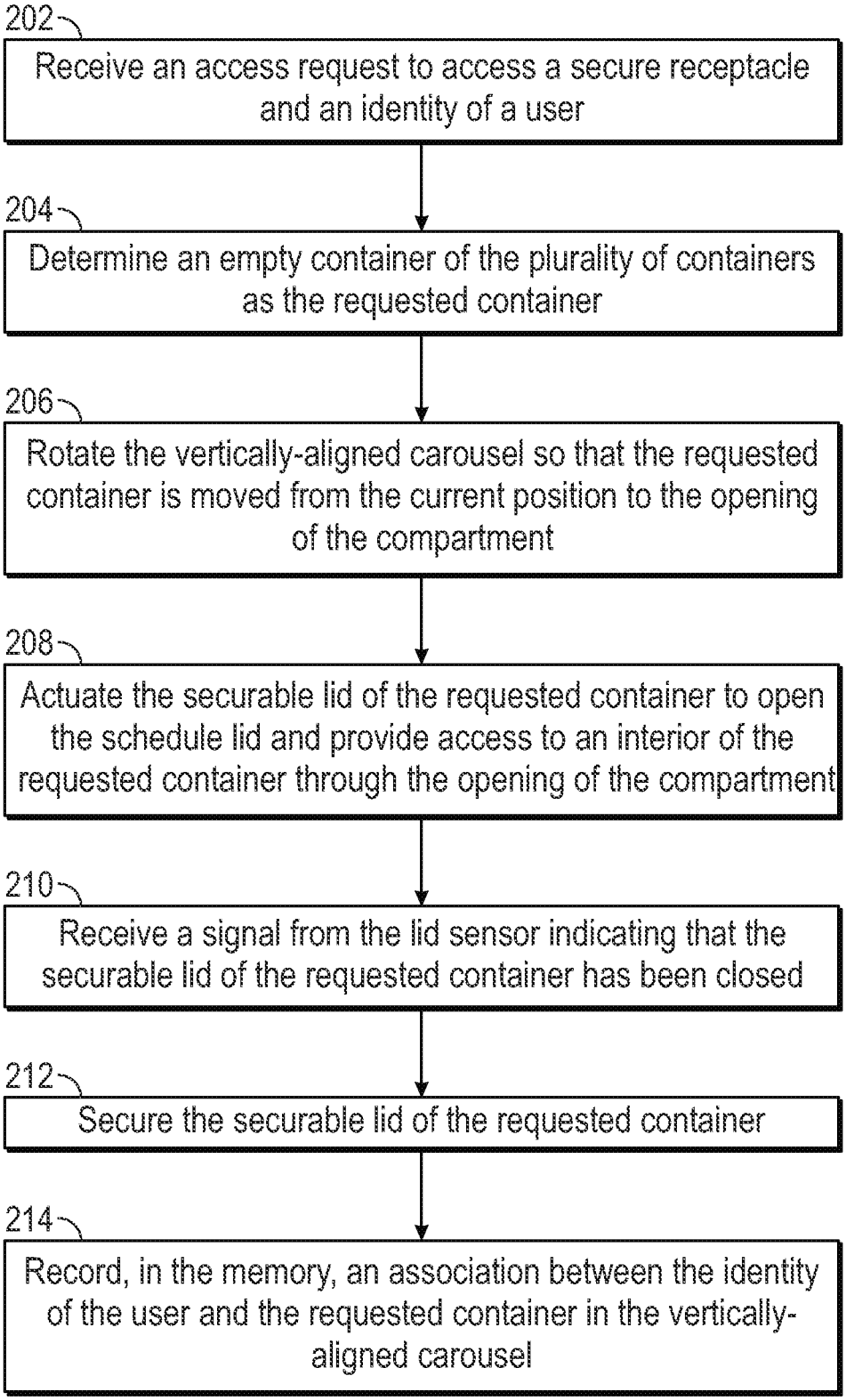
FIG. 19 depicts an example process for controlling a secure receptacle, according to aspects of the subject technology.

FIG. 19 depicts an example process 200 for controlling a secure receptacle 30, according to aspects of the subject technology. For explanatory purposes, the various blocks of example process 800 are described herein with reference to FIGS. 1 to 18, and the components and/or processes described herein. The one or more of the blocks of process 200 may be implemented, for example, by one or more computing devices including, for example, circuit module(s) 64 or 66, the processor of ADM 12, or processor 120 of smart carrier 100. In some implementations, one or more of the blocks may be implemented based on one or more machine learning algorithms. In some implementations, one or more of the blocks may be implemented apart from other blocks, and by one or more different processors or devices. Further for explanatory purposes, the blocks of example process 200 are described as occurring in serial, or linearly. However, multiple blocks of example process 200 may occur in parallel. In addition, the blocks of example process 200 need not be performed in the order shown and/or one or more of the blocks of example process 200 need not be performed.

In the depicted example, an access request to access a secure receptacle 30 and an identity of a user is received (202). Secure receptacle 30 includes a vertically-aligned carousel 50 disposed within an interior compartment of the secure receptacle. According to various implementations, vertically-aligned carousel 50 includes a plurality of secure containers 52 horizontally disposed around a rotational axis 53 of the carousel. In some implementations, the carousel 50 and the containers 52 may be formed from one piece, for example molded from plastic as shown in FIG. 7. Each secure container 52 may include a securable lid 56 preventing access to the secure container 30 when the securable lid is in a closed position. Carousel 50 may be configured to lock in a secured position in which each securable lid 56 of each of the plurality of containers 56 is in the closed position.

Secure receptacle 30 includes a docking interface including one or more electrical connectors disposed on an outer portion of the body of secure receptacle for docking secure receptacle 30 with a docking station and communicating with a processor of the docking station. Secure receptacle 30 may be, for example, docked with a docking station of an ADM 12 or smart carrier 100, or other computing device adapted to interface with secure receptacle 30. A processor of ADM 12 or smart carrier 100, or a processor of secure receptacle 30 based on information from an input source such as the processor of ADM 12 or smart carrier 100 (or other similarly situated device) sends the access request to the secure receptacle. The access request may be based on user input, and may be in the form of or included in one or more commands sent to secure receptacle 30. The user input may have been for a particular medication or medical item stored in secure receptacle 30.

A requested container of the plurality of secure containers is then determined (204). The determination may be based on the received one or more commands. Secure container 30 may include an inventory in a memory device, associated with containers 52. In this regard secure container 30 may receive a request for an item and index the inventory to determine the container containing the item. In some implementations, the indexing may occur at ADM 12 or smart carrier 100, or other computing device, and the commands may include the location or selection of container 52.

The vertically-aligned carousel 50 is rotated so that the requested container is moved from a current position to an opening of the securable receptacle (206). According to various implementations, carousel 50 may be rotated by a motorized controller 62. As described previously, a processor of receptacle 30 may be communicatively connected to a docking interface, a sensor, and the motorized controller. The receptacle processor may receive the one or more commands from the processor of the docking station, receives the current position of the requested container 52 (or carousel 50) from the sensor, and instructs the motorized controller to rotate the carousel without further action by the processor of the docking station.

Carousel 50 may include an actuation lever on a side of the carousel within the compartment, in addition to a plurality of lid latches, each operably connected to a respective lid 56 of the plurality of secure containers 52. Each lid latch may be configured to secure the respective lid in a closed position until actuated by the actuation lever when the vertically-aligned carousel rotates in a first direction past the actuation lever. Each respective lid 56 of the containers 52 of the carousal may be configured to remain in the closed position while the carousel rotates in a second direction, and wherein, responsive to the one or more commands, the motorized controller rotates the vertically-aligned carousel in the second direction until the requested container moves past the opening of the compartment and then rotates the vertically-aligned carousel in the first direction to actuate the respective lid and to actuate the securable lid of the requested container to provide access to an interior of the requested container through the opening of the compartment.

According to some implementations, carousel 50 is rotatable only when each locking receptacle lid is closed and locked. In some implementations, rotation of carousal 50 and/or opening of a lid 56 is based on the user having the proper credentials. Authentication may be provided by the external device or a memory device of secure receptacle 30 may store authentication information that may be used to authenticate the user when the one or commands are received.

The securable lid of the requested container is actuated to open the securable lid and provide access to an interior of the requested container through an opening of the secure receptacle (208). The user may then retrieve an item from the requested container 52. If the secure receptacle is being used to deposit an item, then the user may deposit the item in container 52. A signal is received, for example by a processor from a lid sensor within the secure receptacle, indicating that the lid of the requested container has been closed (210). The securable lid 56 of the requested container 52 is secured (212). In this regard, the lid may be closed as described in FIGS. 6B to 6D. An association between the identity of the user and the requested container in the vertically-aligned carousel is then recorded in a memory device associated with the secure receptacle (214). This association may then be used by an ADM 12 or other computing device interfacing with secure receptacle 30 to determine a history of inventory activities associated with secure receptacle 30.

Many of the above-described examples of FIGS. 1 to 19, and related features and applications, may also be implemented as software processes that are specified as a set of instructions recorded on a computer readable storage medium (also referred to as computer readable medium), and may be executed automatically (e.g., without user intervention). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

The term "software" is meant to include, where appropriate, firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Figure 20:
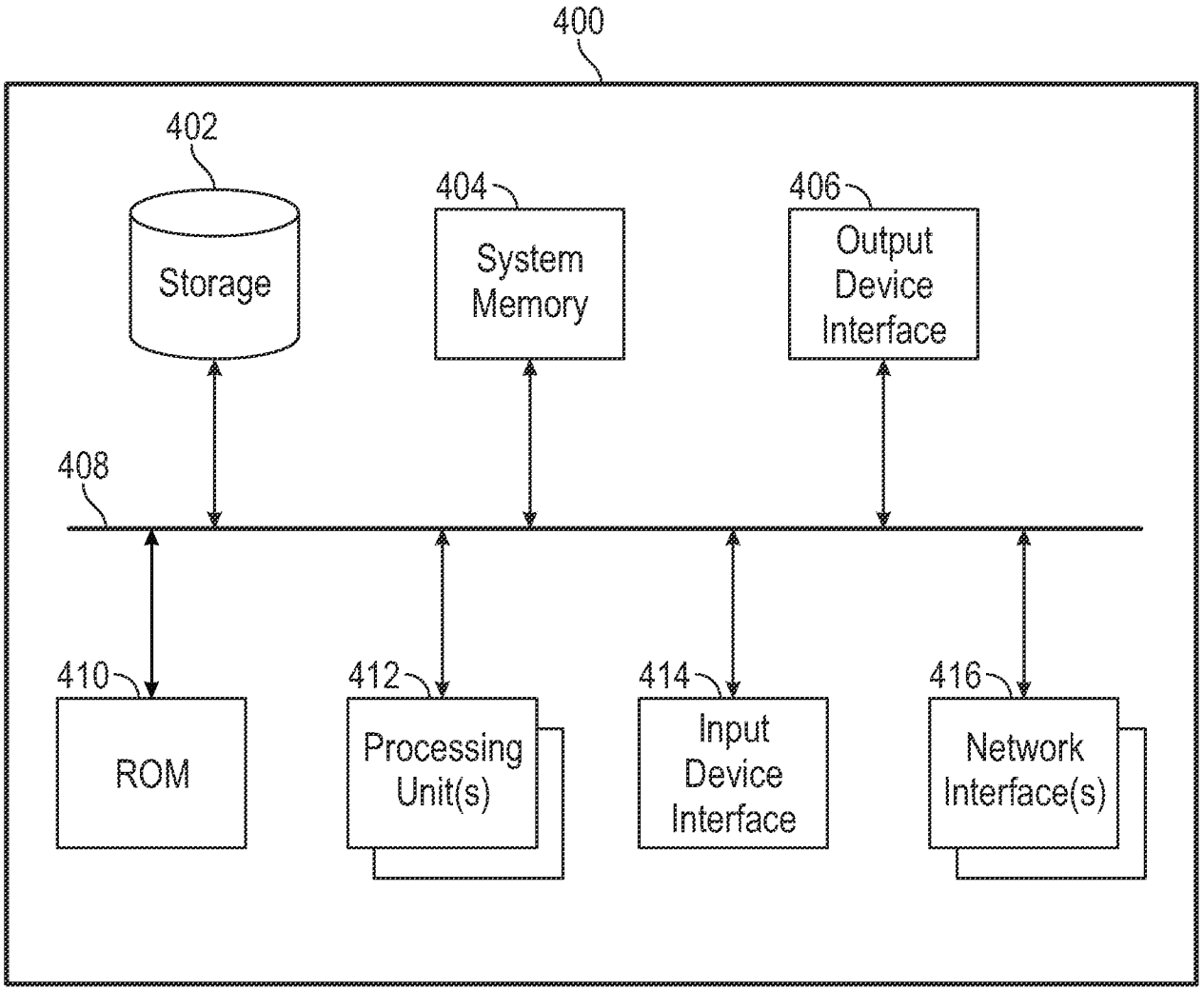
FIG. 20 is a conceptual diagram illustrating an example electronic system for controlling a secure receptacle, according to aspects of the subject technology.

FIG. 20 is a conceptual diagram illustrating an example electronic system 400 for controlling a secure receptacle 30, according to aspects of the subject technology. Electronic system 400 may execute software instructions associated with one or more portions or steps of process 200, or components and processes provided by FIGS. 1-18. System 400 may be part of secure receptacle, including but not limited to circuit module(s) 64 or 66, or associated with or include the processor of ADM 12, or processor 120 of smart carrier 100, or a computing device operably connected to any of the foregoing. Electronic system 400 may be representative, in combination with the disclosure regarding FIGS. 1-19. In this regard, electronic system 400 may be a PCBA, a personal computer or a mobile device such as a smartphone, tablet computer, laptop, PDA, an augmented reality device, a wearable such as a watch or band or glasses, or combination thereof, or other touch screen or television with one or more processors embedded therein or coupled thereto, or any other sort of computer-related electronic device having network connectivity.

Electronic system 400 may include various types of computer readable media and interfaces for various other types of computer readable media. In the depicted example, electronic system 400 includes a bus 408, processing unit(s) 412, a system memory 404, a read-only memory (ROM) 410, a permanent storage device 402, an input device interface 614, an output device interface 406, and one or more network interfaces 416. In some implementations, system memory 404 and/or ROM 410 may be part of secure receptacle, as previously described. In some implementations, electronic system 400 may include or be integrated with other computing devices or circuitry for operation of the various components and processes previously described.

Bus 408 collectively represents all system, peripheral, and chipset buses that communicatively connect the numerous internal devices of electronic system 400. For instance, bus 408 communicatively connects processing unit(s) 412 with ROM 410, system memory 404, and permanent storage device 402.

From these various memory units, processing unit(s) 412 retrieves instructions to execute and data to process in order to execute the processes of the subject disclosure. The processing unit(s) can be a single processor or a multi-core processor in different implementations.

ROM 410 stores static data and instructions that are needed by processing unit(s) 412 and other modules of the electronic system. Permanent storage device 402, on the other hand, is a read-and-write memory device. This device is a non-volatile memory unit that stores instructions and data even when electronic system 400 is off. Some implementations of the subject disclosure use a mass-storage device (such as a magnetic or optical disk and its corresponding disk drive) as permanent storage device 402.

Other implementations use a removable storage device (such as a floppy disk, flash drive, and its corresponding disk drive) as permanent storage device 402. Like permanent storage device 402, system memory 404 is a read-and-write memory device. However, unlike storage device 402, system memory 404 is a volatile read-and-write memory, such as a random access memory. System memory 404 stores some of the instructions and data that the processor needs at runtime. In some implementations, the processes of the subject disclosure are stored in system memory 404, permanent storage device 402, and/or ROM 410. From these various memory units, processing unit(s) 412 retrieves instructions to execute and data to process in order to execute the processes of some implementations.

Bus 408 also connects to input and output device interfaces 414 and 406. Input device interface 414 enables the user to communicate information and select commands to the electronic system. Input devices used with input device interface 414 include, e.g., alphanumeric keyboards and pointing devices (also called "cursor control devices"). Output device interfaces 406 enables, e.g., the display of images generated by the electronic system 400. Output devices used with output device interface 406 include, e.g., printers and display devices, such as cathode ray tubes (CRT) or liquid crystal displays (LCD). Some implementations include devices such as a touchscreen that functions as both input and output devices.

Also, as shown in FIG. 4, bus 408 also couples electronic system 400 to a network (not shown) through network interfaces 416. Network interfaces 416 may include, e.g., a wireless access point (e.g., Bluetooth or WiFi) or radio circuitry for connecting to a wireless access point. Network interfaces 416 may also include hardware (e.g., Ethernet hardware) for connecting the computer to a part of a network of computers such as a local area network ("LAN"), a wide area network ("WAN"), wireless LAN, or an Intranet, or a network of networks, such as the Internet. Any or all components of electronic system 400 can be used in conjunction with the subject disclosure.

These functions described above can be implemented in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (also referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; e.g., feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; e.g., by sending web pages to a web browser on a user's client device in response to requests received from the web browser.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and may interact through a communication network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a user interacting with the client device). Data generated at the client device (e.g., a result of the user interaction) can be received from the client device at the server.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. The described functionality may be implemented in varying ways for each particular application. Various components and blocks may be arranged differently (e.g., arranged in a different order, or partitioned in a different way) all without departing from the scope of the subject technology.

It is understood that the specific order or hierarchy of steps in the processes disclosed is an illustration of example approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Illustration of Subject Technology as Clauses:

Various examples of aspects of the disclosure are described as numbered clauses (1, 2, 3, etc.) for convenience. These are provided as examples, and do not limit the subject technology. Identifications of the figures and reference numbers are provided below merely as examples and for illustrative purposes, and the clauses are not limited by those identification.

Clause 1. A secure receptacle, comprising: a body forming a compartment therein and comprising an opening to the compartment; a docking interface comprising one or more electrical connectors disposed on an outer portion of the body for docking the secure receptacle with a docking station and communicating with a processor of the docking station; a vertically-aligned carousel disposed within the compartment and comprising a plurality of securable containers horizontally disposed around a rotational axis of the vertically-aligned carousel, each securable container comprising a securable lid preventing access to the secure container when the securable lid is in a closed position, wherein the vertically-aligned carousel is configured to lock in a secured position in which each securable lid of each of the plurality of secure containers in the closed position; a sensor for determining a position of the vertically-aligned carousel and identifying which of the plurality of securable containers is positioned at the opening of the compartment; a motorized controller configured to rotate the vertically-aligned carousel based on one or more commands received via the docking interface from the processor of the docking station, wherein the secure receptacle is configured to receive the one or more commands from the docking interface and, in response to the one or more commands, determine based on the one or more commands a requested container of the plurality of securable containers, obtain a current position of the requested container using the sensor, and rotate the vertically-aligned carousel so that the requested container is moved from the current position to the opening of the compartment, and actuate the securable lid of the requested container to provide access to an interior of the requested container through the opening of the compartment.

Clause 2. The secure receptacle of Clause 1, wherein the vertically-aligned carousel comprises: an actuation lever on a side of the vertically-aligned carousel within the compartment; and a plurality of lid latches, each operably connected to a respective lid of the plurality of secure containers and configured to secure the respective lid in a closed position until actuated by the actuation lever when the vertically-aligned carousel rotates in a first direction past the actuation lever.

Clause 3. The secure receptacle of Clause 2, wherein each respective lid remains in the closed position while the vertically-aligned carousel rotates in a second direction, and wherein, responsive to the one or more commands, the motorized controller rotates the vertically-aligned carousel in the second direction until the requested container moves past the opening of the compartment and then rotates the vertically-aligned carousel in the first direction to actuate the respective lid and to actuate the securable lid of the requested container to provide access to an interior of the requested container through the opening of the compartment.

Clause 4. The secure receptacle of Clause 3, further comprising: a locking receptacle lid; wherein the vertically-aligned carousel is rotatable only when the locking receptacle lid closed and locked, wherein the secure receptacle is configured to unlock the locking receptacle lid responsive to an authorization received in connection with the one or more commands, and wherein access to the interior of the requested container is provided only when the locking receptacle lid is unlocked and the securable lid of the requested container is actuated.

Clause 5. The secure receptacle of any one of Clauses 1 through 4, wherein the sensor and the motorized controller are configured to be controlled by the processor of the docking station when the secure receptacle is docked with the docking station.

Clause 6. The secure receptacle of any one of Clauses 1 through 5, further comprising: a receptacle processor communicatively connected to the docking interface, the sensor, and the motorized controller, wherein the receptacle processor receives the one or more commands from the processor of the docking station, receives the current position from the sensor, and instructs the motorized controller to rotate the vertically-aligned carousel without further action by the processor of the docking station.

Clause 7. The secure receptacle of Clause 6, further comprising: a non-transitory machine-readable memory accessible by the processor; and a lid sensor, wherein the processor of the secure receptacle is configured to: receive the one or more commands via the docking interface, the one or more commands comprising a request to deposit an item in the secure receptacle and an identify of a user; determine, based on information stored in the memory, an empty container of the plurality of securable containers as the requested container;

rotate the vertically-aligned carousel so that the requested container is moved from the current position to the opening of the compartment; actuate the securable lid of the requested container to open the securable lid and provide access to an interior of the requested container through the opening of the compartment; receive a signal from the lid sensor indicating that the securable lid of the requested container has been closed; secure the securable lid of the requested container; and record, in the memory, an association between the identity of the user and the requested container in the vertically-aligned carousel.

Clause 8. The secure receptacle of any one of Clauses 1 through 5, further comprising: a top cover perimeter forming the opening to the compartment and having a top cover opening smaller than a perimeter of the body at the opening to the compartment; an indexing carousel drive wheel coupled to the vertically-aligned carousel and configured to advance the vertically-aligned carousel one-half a compartment at a time such that when the vertically-aligned carousel is in the secured position, with each securable lid of each of the plurality of securable containers in the closed position, two of the securable lids are at least partially blocked by the top cover opening; and a mechanical lock configured to prevent the indexing carousel drive wheel from advancing the vertically-aligned carousel when the vertically-aligned carousel is in the secured position.

Clause 9. The secure receptacle of Clause 8, further comprising: a locking arm extending from an access area adjacent the opening to the compartment to the mechanical lock, the locking arm preventing the indexing carousel drive wheel from advancing the vertically-aligned carousel when the vertically-aligned carousel is in the secured position; and a locking release tab coupled to the locking arm at the access area, the locking release tab configured to permanently break free from the locking arm to release the vertically-aligned carousel from the secured position.

Clause 10. The secure receptacle of Clause 9, further comprising: a receptacle processor; a non-transitory machine-readable memory accessible by the receptacle processor; and a release tab sensor; wherein the receptacle processor is configured to: determine, based on the one or more commands received via the docking interface, an identify of a user; receive from the release tab sensor an indication that the locking release tab is broken free from the locking arm; and in response to receiving the indication that the locking release tab is broken free from the locking arm, record, in the memory, an association between the identity of the user and the indication and a current position of the vertically-aligned carousel.

Clause 11. A method, comprising: receiving an access request to access a secure receptacle and an identity of a user, the secure receptacle being docked with a docking station and comprising a vertically-aligned carousel disposed within a compartment of the secure receptacle, the vertically-aligned carousel comprising a plurality of securable containers horizontally disposed around a rotational axis of the vertically-aligned carousel, each secure container comprising a securable lid preventing access to the secure container when the securable lid is in a closed position, wherein the vertically-aligned carousel is configured to lock in a secured position in which each securable lid of each of the plurality of securable containers in the closed position; determining, based on the one or more commands, a requested container of the plurality of secure containers; rotating the vertically-aligned carousel so that the requested container is moved from a current position to an opening of the securable receptacle; actuating the securable lid of the requested container to open the securable lid and provide access to an interior of the requested container through an opening of the secure receptacle; receiving, from a lid sensor within the secure receptacle, a signal indicating that the lid of the requested container has been closed; securing the securable lid of the requested container; and recording, in a memory device associated with the secure receptacle, an association between the identity of the user and the requested container in the vertically-aligned carousel.

Clause 12. The method of Clause 11, further comprising: determining, based on a position sensor within the securable receptacle, a position of the vertically-aligned carousel which of the plurality of securable containers is positioned at the opening of the compartment; rotating, using a motorized controller within the securable receptacle, the vertically-aligned carousel based on one or more commands provided to a docking interface of the docking station; an actuation lever on a side of the vertically-aligned carousel within the compartment; and a plurality of lid latches, each operably connected to a respective lid of the plurality of secure containers and configured to secure the respective lid in a closed position until actuated by the actuation lever when the vertically-aligned carousel rotates in a first direction past the actuation lever.

Clause 13. The method of Clause 12, further comprising: rotating, responsive to the one or more commands, the vertically-aligned carousel in the first direction until the requested container moves past the opening of the secure receptacle, wherein each respective lid remains in the closed position while the vertically-aligned carousel rotates in a first direction; rotating the vertically-aligned carousel in a second direction to actuate the respective lid and to actuate the securable lid of the requested container to provide access to an interior of the requested container through the opening of the compartment.

Clause 14. The method of Clause 13, wherein the secure receptacle comprises a locking receptacle lid and the vertically-aligned carousel is rotatable only when the locking receptacle lid closed and locked, the method further comprising: unlocking the locking receptacle lid responsive to an authorization received in connection with the one or more commands, wherein access to the interior of the requested container is provided only when the locking receptacle lid is unlocked and the securable lid of the requested container is actuated.

Clause 15. The method of any one of Clauses 11 through 14, further comprising: controlling a motorized controller within the securable receptacle by a processor of the docking station when the secure receptacle is docked with the docking station.

Clause 16. The method of any one of Clauses 11 through 15, further comprising: receiving, by a receptacle processor within the secure receptacle, the one or more commands from a processor of a docking station; obtaining, by the receptacle processor, the current position from a position sensor within the securable receptacle; and instructing a motorized controller within the secure receptacle to rotate the vertically-aligned carousel without further action by the processor of the docking station.

Clause 17. The method of Clause 16, further comprising: receiving a request to deposit an item in an empty container of the plurality of securable containers; rotating, based on the request, the vertically-aligned carousel so that the requested container is moved from the current position to the opening of the compartment; and actuating the securable lid of the requested container to open the securable lid and provide access to an interior of the requested container through the opening of the compartment, wherein the association is recorded responsive to receiving the signal indicating that the lid of the requested container has been closed.

Clause 18. The method of any one of Clauses 11 through 15, further comprising: advancing the vertically-aligned carousel one-half a compartment at a time such that when the vertically-aligned carousel is in the secured position, with each securable lid of each of the plurality of securable containers in the closed position, two of the securable lids are at least partially blocked by a top cover opening of the secure receptacle, the top cover opening being smaller than a perimeter of the opening of the securable container; and causing a mechanical lock to prevent the vertically-aligned carousel from advancing when the vertically-aligned carousel is in the secured position.

Clause 19. The method of Clause 18, further comprising: receiving, from a release tab sensor within the secure receptacle, an indication that a locking release tab has broken free from a locking arm, the locking arm extending from an access area adjacent the opening to the compartment to the mechanical lock, the locking arm preventing the vertically-aligned carousel from advancing when the vertically-aligned carousel is in the secured position, the locking release tab configured to, when broken free from the locking arm, release the vertically-aligned carousel from the secured position; and in response to receiving the indication that the locking release tab is broken free from the locking arm, recording, in the memory device, an association between the identity of the user and the indication and a current position of the vertically-aligned carousel.

Clause 20. The method of Clause 19, further comprising: receiving a request for an item in the secure receptacle; sending, responsive to the request, the one or more commands to the secure receptacle via a docking interface; obtaining a current position of the requested container using the sensor; rotating the vertically-aligned carousel so that the requested container is moved from the current position to the opening of the compartment, and actuate the securable lid of the requested container to provide access to an interior of the requested container through the opening of the compartment.

Clause 21. A non-transitory machine-readable medium having instructions stored thereon that, when executed by one or more processors, cause the one or more processors to perform a method according to any one of Clauses 11 through 20.

Further Consideration:

It is understood that the specific order or hierarchy of steps in the processes disclosed is an illustration of example approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

The previous description is provided to enable a person of ordinary skill in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the terms "a set" and "some" refer to one or more. Pronouns in the masculine (e.g., his) include the feminine and neuter gender (e.g., her and its) and vice versa. Headings and subheadings, if any, are used for convenience only and do not limit the invention.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by any claim. Furthermore, to the extent that the term "include," "have," or the like is used in the description, such term is intended to be inclusive in a manner similar to the term "comprise" as "comprise" is interpreted when employed as a transitional word.

What is claimed is:

1. A secure receptacle, comprising:

a body forming a compartment therein and comprising an opening to the compartment;

a docking interface comprising one or more electrical connectors disposed on an outer portion of the body for docking the secure receptacle with a docking station and communicating with a processor of the docking station;

a vertically-aligned carousel disposed within the compartment and comprising a plurality of securable containers formed within a single structure and horizontally disposed around a rotational axis of the vertically-aligned carousel in the single structure such that respective floors of each of the plurality of securable containers form a polygon that rotates around the rotational axis, each securable container comprising a securable lid preventing access to the secure container when the securable lid is in a closed position, wherein the vertically-aligned carousel is configured to lock in a secured position in which each securable lid of each of the plurality of secure containers in the closed position;

a sensor for determining a position of the vertically-aligned carousel and identifying which of the plurality of securable containers is positioned at the opening of the compartment;

a motorized controller configured to rotate the vertically-aligned carousel based on one or more commands received via the docking interface from the processor of the docking station, wherein the secure receptacle is configured to receive the one or more commands from the docking interface and, in response to the one or more commands, determine based on the one or more commands a requested container of the plurality of securable containers, obtain a current position of the requested container using the sensor, and rotate the vertically-aligned carousel so that the requested container is moved from the current position to the opening of the compartment, and actuate the securable lid of the requested container to provide access to an interior of the requested container through the opening of the compartment.

2. The secure receptacle of claim 1, wherein the vertically-aligned carousel comprises:

an actuation lever on a side of the vertically-aligned carousel within the compartment; and a plurality of lid latches, each operably connected to a respective lid of the plurality of secure containers and configured to secure the respective lid in a closed position until actuated by the actuation lever when the vertically-aligned carousel rotates in a first direction past the actuation lever.

3. The secure receptacle of claim 2, wherein each respective lid remains in the closed position while the vertically-aligned carousel rotates in a second direction, and wherein, responsive to the one or more commands, the motorized controller rotates the vertically-aligned carousel in the second direction until the requested container moves past the opening of the compartment and then rotates the vertically-aligned carousel in the first direction to actuate the respective lid and to actuate the securable lid of the requested container to provide access to an interior of the requested container through the opening of the compartment.

4. The secure receptacle of claim 3, further comprising:

a locking receptacle lid;

wherein the vertically-aligned carousel is rotatable only when the locking receptacle lid is closed and locked, wherein the secure receptacle is configured to unlock the locking receptacle lid responsive to an authorization received in connection with the one or more commands, and wherein access to the interior of the requested container is provided only when the locking receptacle lid is unlocked and the securable lid of the requested container is actuated.

5. The secure receptacle of claim 1, wherein the sensor and the motorized controller are configured to be controlled by the processor of the docking station when the secure receptacle is docked with the docking station.

6. The secure receptacle of claim 1, further comprising:

a receptacle processor communicatively connected to the docking interface, the sensor, and the motorized controller, wherein the receptacle processor receives the one or more commands from the processor of the docking station, receives the current position from the sensor, and instructs the motorized controller to rotate the vertically-aligned carousel without further action by the processor of the docking station.

7. The secure receptacle of claim 6, further comprising:

a non-transitory machine-readable memory accessible by the processor; and a lid sensor, wherein the processor of the secure receptacle is configured to:

receive the one or more commands via the docking interface, the one or more commands comprising a request to deposit an item in the secure receptacle and an identity of a user;

determine, based on information stored in the non-transitory machine-readable memory, an empty container of the plurality of securable containers as the requested container;

rotate the vertically-aligned carousel so that the requested container is moved from the current position to the opening of the compartment;

actuate the securable lid of the requested container to open the securable lid and provide access to an interior of the requested container through the opening of the compartment;

receive a signal from the lid sensor indicating that the securable lid of the requested container has been closed;

secure the securable lid of the requested container; and record, in the memory, an association between the identity of the user and the requested container in the vertically-aligned carousel.

8. The secure receptacle of claim 1, further comprising:

a top cover perimeter forming the opening to the compartment and having a top cover opening smaller than a perimeter of the body at the opening to the compartment;

an indexing carousel drive wheel coupled to the vertically-aligned carousel and configured to advance the vertically-aligned carousel one-half a compartment at a time such that when the vertically-aligned carousel is in the secured position, with each securable lid of each of the plurality of securable containers in the closed position, two of the securable lids are at least partially blocked by the top cover opening; and a mechanical lock configured to prevent the indexing carousel drive wheel from advancing the vertically-aligned carousel when the vertically-aligned carousel is in the secured position.

9. The secure receptacle of claim 8, further comprising:

a locking arm extending from an access area adjacent the opening to the compartment to the mechanical lock, the locking arm preventing the indexing carousel drive wheel from advancing the vertically-aligned carousel when the vertically-aligned carousel is in the secured position; and a locking release tab coupled to the locking arm at the access area, the locking release tab configured to permanently break free from the locking arm to release the vertically-aligned carousel from the secured position.

10. The secure receptacle of claim 9, further comprising:

a receptacle processor;

a non-transitory machine-readable memory accessible by the receptacle processor; and a release tab sensor;

wherein the receptacle processor is configured to:

determine, based on the one or more commands received via the docking interface, an identity of a user;

receive from the release tab sensor an indication that the locking release tab is broken free from the locking arm; and in response to receiving the indication that the locking release tab is broken free from the locking arm, record, in the memory, an association between the identity of the user and the indication and a current position of the vertically-aligned carousel.

11. A method, comprising:

receiving an access request to access a secure receptacle and an identity of a user, the secure receptacle being docked with a docking station and comprising a vertically-aligned carousel disposed within a compartment of the secure receptacle, the vertically-aligned carousel comprising a plurality of securable containers formed within a single structure and horizontally disposed around a rotational axis of the vertically-aligned carousel in the single structure such that respective floors of each of the plurality of securable containers form a polygon that rotates around the rotational axis, each secure container comprising a securable lid preventing access to the secure container when the securable lid is in a closed position, wherein the vertically-aligned carousel is configured to lock in a secured position in which each securable lid of each of the plurality of securable containers in the closed position;

determining, based on one or more commands, a requested container of the plurality of secure containers;

rotating the vertically-aligned carousel so that the requested container is moved from a current position to an opening of the securable receptacle;

actuating the securable lid of the requested container to open the securable lid and provide access to an interior of the requested container through an opening of the secure receptacle;

receiving, from a lid sensor within the secure receptacle, a signal indicating that the securable lid of the requested container has been closed;

securing the securable lid of the requested container; and recording, in a memory device associated with the secure receptacle, an association between the identity of the user and the requested container in the vertically-aligned carousel.

12. The method of claim 11, wherein the vertically-aligned carousel comprises an actuation lever on a side of the vertically-aligned carousel within the compartment, and a plurality of lid latches, each operably connected to a respective lid of the plurality of secure containers, the method further comprising:

determining, based on a position sensor within the securable receptacle, a position of the vertically-aligned carousel which of the plurality of securable containers is positioned at the opening of the compartment;

rotating, using a motorized controller within the securable receptacle, the vertically-aligned carousel based on one or more commands provided to a docking interface of the docking station; and securing the respective lid in a closed position until actuated by the actuation lever when the vertically-aligned carousel rotates in a first direction past the actuation lever.

13. The method of claim 12, further comprising:

rotating, responsive to the one or more commands, the vertically-aligned carousel in the first direction until the requested container moves past the opening of the secure receptacle, wherein each respective lid remains in the closed position while the vertically-aligned carousel rotates in a first direction;

rotating the vertically-aligned carousel in a second direction to actuate the respective lid and to actuate the securable lid of the requested container to provide access to an interior of the requested container through the opening of the compartment.

14. The method of claim 13, wherein the secure receptacle comprises a locking receptacle lid and the vertically-aligned carousel is rotatable only when the locking receptacle lid closed and locked, the method further comprising:

unlocking the locking receptacle lid responsive to an authorization received in connection with the one or more commands, wherein access to the interior of the requested container is provided only when the locking receptacle lid is unlocked and the securable lid of the requested container is actuated.

15. The method of claim 11, further comprising:

controlling a motorized controller within the securable receptacle by a processor of the docking station when the secure receptacle is docked with the docking station.

16. The method of claim 11, further comprising:

receiving, by a receptacle processor within the secure receptacle, the one or more commands from a processor of a docking station;

obtaining, by the receptacle processor, the current position from a position sensor within the securable receptacle; and instructing a motorized controller within the secure receptacle to rotate the vertically-aligned carousel without further action by the processor of the docking station.

17. The method of claim 16, further comprising:

receiving a request to deposit an item in an empty container of the plurality of securable containers;

rotating, based on the request, the vertically-aligned carousel so that the requested container is moved from the current position to the opening of the compartment; and actuating the securable lid of the requested container to open the securable lid and provide access to an interior of the requested container through the opening of the compartment, wherein the association is recorded responsive to receiving the signal indicating that the securable lid of the requested container has been closed.

18. The method of claim 11, further comprising:

advancing the vertically-aligned carousel one-half a compartment at a time such that when the vertically-aligned carousel is in the secured position, with each securable lid of each of the plurality of securable containers in the closed position, two of the securable lids are at least partially blocked by a top cover opening of the secure receptacle, the top cover opening being smaller than a perimeter of the opening of the securable container; and causing a mechanical lock to prevent the vertically-aligned carousel from advancing when the vertically-aligned carousel is in the secured position.

19. The method of claim 18, further comprising:

receiving, from a release tab sensor within the secure receptacle, an indication that a locking release tab has broken free from a locking arm, the locking arm extending from an access area adjacent the opening to the compartment to the mechanical lock, the locking arm preventing the vertically-aligned carousel from advancing when the vertically-aligned carousel is in the secured position, the locking release tab configured to, when broken free from the locking arm, release the vertically-aligned carousel from the secured position; and in response to receiving the indication that the locking release tab is broken free from the locking arm, recording, in the memory device, an association between the identity of the user and the indication and a current position of the vertically-aligned carousel.

20. The method of claim 19, further comprising:

receiving a request for an item in the secure receptacle;

sending, responsive to the request, the one or more commands to the secure receptacle via a docking interface;

obtaining a current position of the requested container using a position sensor;

rotating the vertically-aligned carousel so that the requested container is moved from the current position to the opening of the compartment, and actuate the securable lid of the requested container to provide access to an interior of the requested container through the opening of the compartment.

* * * * *